US011313138B2

(12) United States Patent
Norwood et al.

(10) Patent No.: US 11,313,138 B2
(45) **Date of Patent: *Apr. 26, 2022**

(54) SYSTEM AND METHOD FOR A VENTED AND WATER CONTROL SIDING, VENTED AND WATER CONTROL SHEATHING AND VENTED AND WATER CONTROL TRIM-BOARD

(71) Applicant: Norwood Architecture, Inc., Louisville, CO (US)

(72) Inventors: Steven Norwood, Louisville, CO (US); Amir Abu-Jaber, Boulder, CO (US)

(73) Assignee: Norwood Architecture, Inc., Louisville, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/847,324

(22) Filed: Apr. 13, 2020

(65) Prior Publication Data

US 2020/0240152 A1 Jul. 30, 2020

Related U.S. Application Data

(63) Continuation of application No. 16/530,934, filed on Aug. 2, 2019, now Pat. No. 10,619,359, which is a (Continued)

(51) Int. Cl.
*E04F 17/00* (2006.01)
*E04B 1/70* (2006.01)
(Continued)

(52) U.S. Cl.
CPC ..... *E04F 17/00* (2013.01); *E04B 1/7038* (2013.01); *E04B 1/7076* (2013.01);
(Continued)

(58) Field of Classification Search
CPC ... E04F 13/007; E04F 13/072; E04F 13/0864; E04C 2/46; E04C 2/523
See application file for complete search history.

(56) References Cited

U.S. PATENT DOCUMENTS 2,264,961 A 12/1941 Ward
2,724,872 A 11/1955 Herbes
(Continued)

FOREIGN PATENT DOCUMENTS

GB 2135710 A 9/1984
JP S60124419 U 8/1985
WO WO 2015123580 8/2015

OTHER PUBLICATIONS

Extended European Search Report for EP 15749545 dated Oct. 11, 2017, 7 pp.

(Continued)

*Primary Examiner* — Rodney Mintz
(74) *Attorney, Agent, or Firm* — Lathrop GPM, LLP

(57) ABSTRACT

A vented and water control paneling has improved drainage and integrated ventilation air space. The water control paneling may be fabricated with an omnidirectional relief pattern formed on its back surface. The relief pattern spaces the vented and water control paneling away from a structure to which it is secured, thereby providing an omnidirectional drainage plane between the back surface of the paneling and the structure. The omnidirectional drainage plane provides an unimpeded ventilation and drainage path of water and/or water vapor.

22 Claims, 28 Drawing Sheets

Related U.S. Application Data continuation of application No. 15/973,311, filed on May 7, 2018, now Pat. No. 10,370,861, which is a continuation of application No. 15/204,796, filed on Jul. 7, 2016, now Pat. No. 9,963,887, which is a continuation-in-part of application No. 14/622,526, filed on Feb. 13, 2015, now Pat. No. 9,394,696.

(60) Provisional application No. 61/955,702, filed on Mar. 19, 2014, provisional application No. 61/940,285, filed on Feb. 14, 2014.

(51) Int. Cl.
*E04F 13/00* (2006.01)
*E04F 13/08* (2006.01)
*E04F 13/072* (2006.01)

(52) U.S. Cl.
CPC ..... *E04F 13/007* (2013.01); *E04F 13/072* (2013.01); *E04F 13/0864* (2013.01)

(56) References Cited

U.S. PATENT DOCUMENTS 3,288,998 A 11/1966 Press
3,318,056 A 5/1967 Thompson
3,339,325 A 9/1967 Knapp
3,538,668 A 11/1970 Anderson
3,561,177 A 2/1971 Agro
3,608,261 A 9/1971 French et al.
3,707,165 A 12/1972 Stahl
3,783,563 A 1/1974 Moore
3,892,902 A 7/1975 Ilukowicz
3,905,855 A 9/1975 Blewett et al.
4,064,300 A 12/1977 Bhangu
4,193,898 A 3/1980 Miller
4,348,442 A 9/1982 Figge
4,674,249 A 6/1987 Bennett, Jr.
4,840,515 A 6/1989 Freese
4,937,990 A 7/1990 Paquette
4,956,951 A 9/1990 Kannankeril
5,044,821 A 9/1991 Johnson
5,050,357 A 9/1991 Lawson
5,491,182 A 2/1996 Key et al.
5,665,470 A 9/1997 Key et al.
5,692,348 A 12/1997 Ambrosino
6,017,597 A 1/2000 Minakami
6,298,620 B1 10/2001 Hatzinikolas
6,569,540 B1 5/2003 Preston
6,672,016 B2 1/2004 Janesky
6,786,013 B2 9/2004 Coulton
6,938,383 B2 * 9/2005 Morris ..... E04B 1/26 52/198
7,117,651 B2 10/2006 Beck
7,472,523 B2 1/2009 Beck
D589,171 S 3/2009 Gleeson
7,748,190 B1 7/2010 Loper
7,765,754 B2 8/2010 Johnson
8,042,309 B2 10/2011 Wolf
8,084,098 B2 12/2011 Mizuno
8,205,403 B2 6/2012 Myers et al.
8,225,568 B1 7/2012 Mollinger et al.
8,404,331 B2 3/2013 Kawakami
8,440,289 B2 5/2013 De Giuseppe
8,590,217 B2 11/2013 Gleeson
8,877,329 B2 11/2014 Ciuperca
8,910,444 B2 12/2014 Wilson et al.
9,022,845 B2 5/2015 Henderson
9,109,363 B2 8/2015 Grau
9,151,043 B1 10/2015 Fritz
9,260,864 B2 2/2016 Cole
9,309,678 B1 4/2016 Mallinger
9,394,696 B2 7/2016 Norwood
9,499,986 B2 11/2016 Kalkanoglu
9,816,265 B2 * 11/2017 Vermeren ..... E04B 1/7625
9,879,400 B1 1/2018 Walker
9,915,073 B1 3/2018 Hood
9,963,887 B2 5/2018 Norwood
10,161,129 B2 12/2018 Hickie
10,174,503 B2 1/2019 Grant
10,364,579 B2 1/2019 Grant
10,370,861 B2 8/2019 Norwood
10,480,188 B2 11/2019 Power
10,619,359 B2 * 4/2020 Norwood ..... E04B 1/7038
10,655,321 B2 * 5/2020 Olson ..... E04B 1/64
10,995,497 B1 * 5/2021 Horne ..... E04D 1/34
2001/0054263 A1 12/2001 Coulton
2002/0182963 A1 12/2002 Bramlett
2003/0024192 A1 2/2003 Spargur
2006/0068188 A1 3/2006 Morse et al.
2006/0075712 A1 * 4/2006 Gilbert ..... E04F 13/0869 52/520
2007/0107304 A1 5/2007 Fan
2007/0130868 A1 * 6/2007 Johnson ..... E04F 13/0864 52/506.01
2007/0175154 A1 8/2007 Wilson et al.
2007/0193150 A1 * 8/2007 Carlson ..... E04F 19/061 52/302.1
2008/0086958 A1 4/2008 Schroer et al.
2008/0163582 A1 7/2008 Trevethick
2008/0209834 A1 9/2008 Ouellette
2009/0007517 A1 1/2009 Swanson
2009/0068370 A1 3/2009 Mizuno
2009/0113838 A1 5/2009 Paulsen
2009/0239977 A1 9/2009 Dubey et al.
2009/0297789 A1 12/2009 Kawakami
2010/0189953 A1 7/2010 Lim
2010/0281801 A1 11/2010 Shaw
2012/0047839 A1 3/2012 Walker
2012/0047844 A1 3/2012 Walker
2012/0096790 A1 4/2012 Wilson
2012/0247040 A1 10/2012 Buoni
2012/0317914 A1 12/2012 Bamberg
2013/0055669 A1 3/2013 Olszewski et al.
2013/0199121 A1 8/2013 Grau
2014/0087158 A1 3/2014 Ciuperca
2014/0093678 A1 4/2014 Walker
2015/0047281 A1 2/2015 Cole
2015/0082722 A1 3/2015 Kalkanoglu
2015/0096248 A1 4/2015 Tebo
2015/0176283 A1 6/2015 Smiley, Jr.
2015/0233121 A1 8/2015 Norwood
2015/0315779 A1 11/2015 Baily et al.
2015/0376895 A1 12/2015 Fox
2016/0040436 A1 2/2016 Grau
2016/0160497 A1 6/2016 Randlett
2016/0160502 A1 6/2016 Brousseau
2016/0194882 A1 7/2016 Cole
2016/0230382 A1 * 8/2016 Vermeren ..... B32B 13/02
2016/0319555 A1 11/2016 Norwood
2017/0198470 A1 7/2017 Hickle
2017/0211280 A1 7/2017 Hubbard
2018/0223530 A1 8/2018 Grant
2018/0251988 A1 9/2018 Norwood
2018/0258633 A1 9/2018 Power
2019/0017279 A1 1/2019 Norwood
2019/0177966 A1 * 6/2019 Olson ..... E04B 1/64
2019/0249419 A1 * 8/2019 Gonzales ..... B32B 15/14
2019/0352918 A1 * 11/2019 Norwood ..... E04F 13/072
2020/0087928 A1 * 3/2020 Norwood ..... E04F 13/007
2020/0095781 A1 * 3/2020 Norwood ..... E04B 1/7076
2020/0270858 A1 * 8/2020 Gonzales ..... B32B 21/14
2020/0277795 A1 * 9/2020 Olson ..... E04F 13/0864
2020/0308844 A1 * 10/2020 Merrick ..... E04F 13/0803
2021/0095469 A1 * 4/2021 Overman ..... B32B 5/02
2021/0129378 A1 * 5/2021 Norwood ..... E04C 5/073

OTHER PUBLICATIONS

U.S. Appl. No. 16/134,663, Non final Office Action dated Nov. 14, 2018, 16 pp.
European Patent Application No. 15749545.8, Communication pursuant to Article 94(3) EPC dated Feb. 28, 2018, 4 pages.

(56) References Cited

OTHER PUBLICATIONS

U.S. Appl. No. 61/775,203 (2003), 9 pages.
Communication pursuant to Article 94(3) EPC for EP 15749545 dated Oct. 24, 2019, 4 pp.
U.S. Appl. No. 16/694,752 Final Office Action dated Jul. 26, 2021, 14 pages.
U.S. Appl. No. 16/694,752 Notice of Allowance dated Sep. 23, 2021, 10 pages.
U.S. Appl. No. 16/694,680 Non-Final Office Action dated Apr. 23, 2021, 16 pages.

* cited by examiner

SYSTEM AND METHOD FOR A VENTED AND WATER CONTROL SIDING, VENTED AND WATER CONTROL SHEATHING AND VENTED AND WATER CONTROL TRIM-BOARD

RELATED APPLICATIONS

This application is a continuation of U.S. application Ser. No. 16/530,934, filed Aug. 2, 2019, which is a continuation of U.S. application Ser. No. 15/973,311, filed May 7, 2018, which is a continuation of U.S. application Ser. No. 15/204,796, filed Jul. 7, 2016, which is a continuation-in-part of U.S. application Ser. No. 14/622,526, filed Feb. 13, 2015, which claims priority to U.S. Provisional Application Ser. No. 61/940,285 filed on Feb. 14, 2014, and U.S. Provisional Application Ser. No. 61/955,702 filed on Mar. 19, 2014. Each of the aforementioned applications is incorporated by reference in its entirety.

BACKGROUND

The exterior walls of buildings are comprised of multiple elements that provide structural support and bracing as well as weather protection for the structure and the interior elements of the building. Typical structural elements include columns, beams, studs, and sheathing. Weather protection elements include siding, panel siding, trim, various cladding systems, and, in some cases, the sheathing. When used on the exterior of a building, sheathing may be applied to the outer face of studs, roof trusses, or rafters of the building to brace the structure, resist wind and other loads and to provide a backing for the exterior weatherproofing systems. In cases, the sheathing itself can serve as one of the weatherproofing elements of the building. Sheathing can be manufactured from a variety of materials including wood, cement, gypsum, insulation, foam insulation, or other suitable materials. Sheathing panels are typically attached directly to wall framing or roof framing members and are typically covered with a wall cladding, siding, or roofing. One example of sheathing is Oriented Strand Board ("OSB"). OSB is a wood and resin based sheathing product typically manufactured in four foot by eight foot sheets. The OSB sheathing is an engineered product used in wood frame construction in applications that historically used plywood or solid sawn wood members. OSB sheathing is typically manufactured with smooth or slightly roughened faces and can be used as a subfloor, roof sheathing, or wall sheathing, among other uses. When used as roof sheathing, the roughened surface of the OSB provides a slip resistant walking surface. When used as wall sheathing, the OSB is nailed or screwed to supporting wood framing. OSB sheathing is not oriented in a particular horizontal or vertical manner and can be cut into different sizes and shapes to sheath the underlying wood framing or furring.

Cladding may be formed from wood, "hardboard" or "pressboard," plastics, cement, gypsum, insulation, foam insulation, or other suitable materials. Cladding is generally referred to as an external weatherproofing element that is attached to the exterior sheathing or framing. The cladding is typically applied over a weather resistant membrane (as used herein the term includes building paper, felt, housewrap, and similar products including liquid or spray applied breathable coatings). In addition to siding, trim, and panel siding, cladding systems include stucco, brick, stone and other materials used to cover the building and provide weather protection. Trim, siding, panel siding, and other cladding systems can trap moisture behind the cladding systems resulting in degradation of the building paper, underlying sheathing, and the wood framing.

Cement board siding, wood siding, and 'hardboard' siding or 'pressboard" siding are typically manufactured with a smooth 'back' or unexposed face, and a 'front' or exposed face, of the siding with a smooth finish or decorative patterns that simulate wood grain. Siding is a subset of cladding that is typically layered, or "lapped," on the exterior surface of the structure to shed water. For siding, the typical installation of the siding is lapped with the upper pieces of siding overlapping the lower pieces of siding as the siding is installed up the typical exterior wall face. This lapped siding installation allows water to shed down the exposed face of the siding. The 'back' or un-exposed face of the siding is typically in contact with the underlying sheathing or building paper. The siding is nailed through the face of the siding, through the sheathing if present, and into the underlying wood framing (studs) of the wall assembly. Some water will reach the back side of the siding and/or the face of the building paper, during rain, snow, or condensation events. In traditional siding, at each level of the siding installation, the back side of the siding is tight against the building paper. At these contact points, or 'pinch points' the flow of water down the building paper is potentially obstructed. In addition, the ventilation of the space behind the siding is potentially obstructed. In traditional siding, the back of siding cannot 'breathe' resulting in potential degradation of the building paper, underlying sheathing, the wood framing.

SUMMARY OF THE INVENTION

To reduce the potential for damage due to moisture and to create an omnidirectional ventilation space behind the siding, trim, or cladding, one embodiment of the present invention introduces raised patterns or bumps to the manufactured back side of siding, trim, or cladding. These raised bumps or patterns create a permanent, omnidirectional, air space and are integral to the manufactured siding, trim or cladding product.

To reduce the potential for damage due to moisture and to create a ventilation space between sheathing and the covering siding or cladding, one embodiment of the present invention introduces raised patterns or bumps to an outwardly facing surface of the sheathing. These raised bumps or patterns create a drainable ventilation space between the sheathing and siding, panel, or cladding materials that form the outer surface of a structure. The patterned sheathing may be covered with a spray applied weather resistant membrane, or other coating, providing increased weather resistance while maintaining the omnidirectional ventilation and drainage air space.

In an embodiment, a vented and water control panel for securing to the exterior of structure includes an omnidirectional relief pattern formed on a back surface of the vented and water control panel. The omnidirectional relief pattern forms an omnidirectional ventilation and drainage plane for moving water and water vapor. The vented and water control panel may be siding, trim-board, siding panel, or cladding element.

In an embodiment, a vented and water control panel sheathing is disclosed. The vented and water control panel sheathing includes a panel body having an outer face, and an inner face. The panel sheathing further includes a plurality of raised surface features extending from the outer face in the form of an omnidirectional relief pattern to provide points of contact between the sheathing and an exterior finish or cladding, when the exterior finish or cladding is applied with the sheathing. Also, a plurality of channels is formed between the raised surface features to facilitate omnidirectional draining and/or ventilation between the panel and the applied exterior finish or cladding. If used as an insulating panel, the sheathing may have an omnidirectional relief pattern on both the outer and inner face (both faces) of the panel.

In another aspect, a structure has improved water drainage and air ventilation, the structure includes a first layer having an interior facing surface and an exterior facing surface, the exterior facing surface having an omnidirectional relief pattern of raised elements thereon; wherein the omnidirectional relief pattern forms an omnidirectional ventilation and drainage plane.

DETAILED DESCRIPTION OF THE FIGURES

Figure 1:
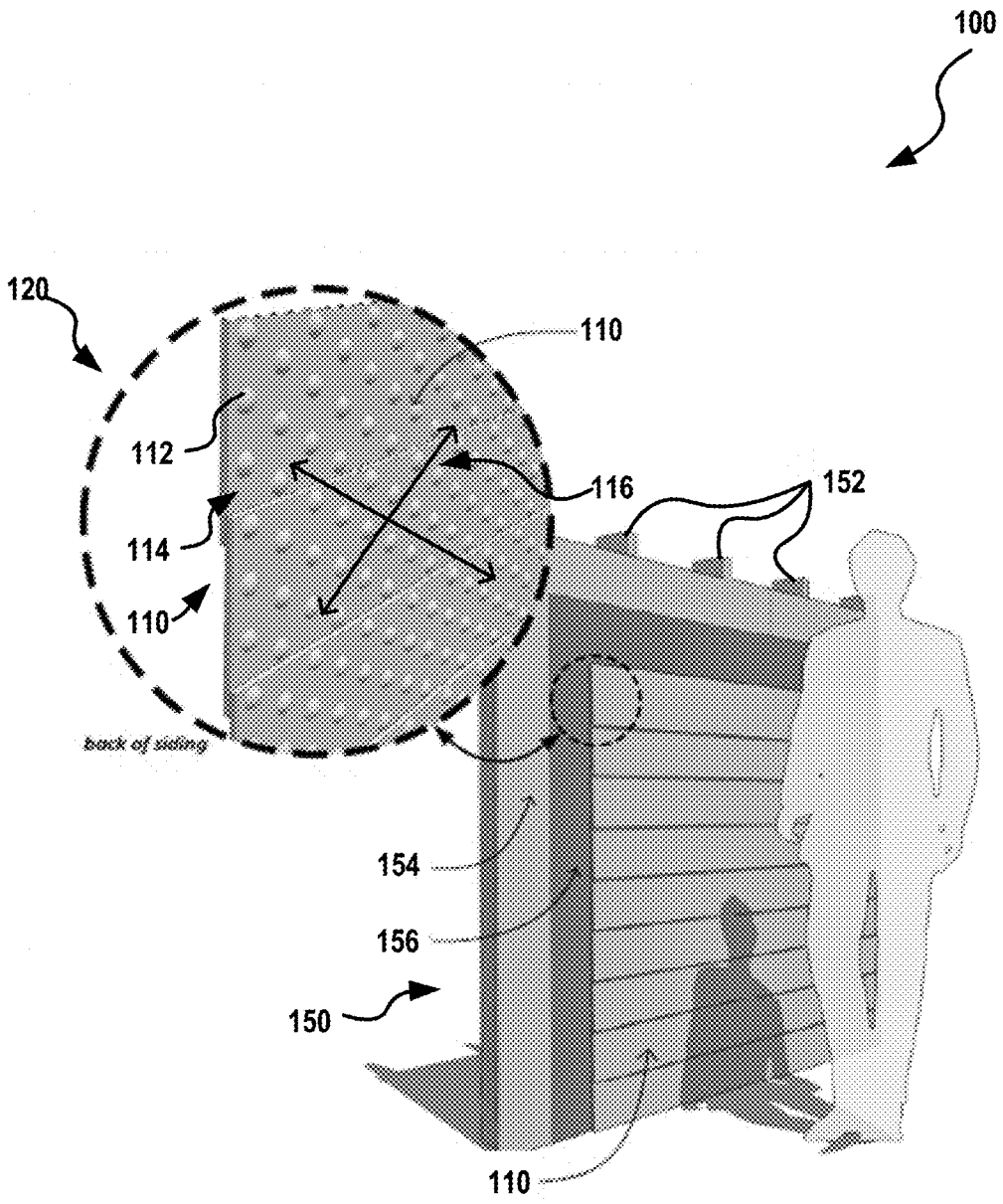
FIG. 1 is a perspective view of an exemplary vented and water control siding secured to a structure, in an embodiment.

Disclosed is a vented and water control siding, trim-board, cladding, and sheathing with improved omnidirectional drainage and integrated air space. The vented and water control siding, trim-board, or cladding may be formed as long, narrow sheets used in siding the exterior of a buildings, is fabricated with an omnidirectional relief pattern formed on the on its back (unexposed) surface. Omnidirectional relief pattern, as used herein means a three-dimensional pattern of raised elements (or lowered elements) on the plane of a surface that allows for air ventilation or moisture drainage in any direction, and not solely a linear direction. The omnidirectional relief pattern holds the siding, trim-board, or cladding away from a structure to which it is secured (hereinafter called "the structure"), thereby providing a ventilation and drainage plane between the back surface of the siding and the structure. This drainage plane provides an omnidirectional path for air and water to flow, and is therefore an omnidirectional drainage plane. An omnidirectional path here means a path for a flow (e.g., air, water, or water vapor) to move substantially unimpeded both along a siding's or series of siding's length and width.

The vented and water control sheathing may be formed as sheets or panels used in sheathing the exterior of a buildings, is fabricated with an omnidirectional relief pattern formed on its front surface. The omnidirectional relief pattern holds subsequent siding or cladding away from the sheathing, thereby providing a drainage plane between the front surface of the sheathing and the siding or cladding. This drainage plane provides an omnidirectional drainage plane.

In the present description, the omnidirectional relief pattern is shown and described as a grid (or array) pattern of raised bumps or "dot" shaped structures and an egg-crate or other three-dimensional pattern of raised features, but it will be understood that any pattern and shaped structures that facilitates an omnidirectional drainage plane can be used without departing from the scope herein. For example, the "bumps" may be pyramids, squares, rectangles, or other shapes may be formed in a grid pattern. A feature of the raised "dot" and "egg-crate" shaped structures is the air space on all sides of the raised shaped structures, which facilitates water and air flow.

By providing an omnidirectional ventilation and drainage plane the risk of moisture related damage to the structure is significantly reduced. The omnidirectional drainage plane provided by the raised patterns allows moisture to spread unhindered over a large surface area, as such drainage is improved and an integrated air space is provided. This differs from the prior art structures, for example using furring strips or similar structures that only provide for a limited substantially linear drainage plane. For example, U.S. Pat. No. 7,472,523 to Beck ("the '523 patent"), entitled "Rainscreen Clapboard Siding" discloses siding with linear protrusions or recesses on the backside of clapboard siding. These protrusions are described as "preferably oriented substantially vertical to the bottom edge 106, i.e., perpendicular to the bottom edge, but may vary as much as ±85° from vertical." (3:38-41). The vertical and horizontal protrusions or recesses of the '523 patent fail to provide omnidirectional drainage, but instead are limited to a linear drainage plane defined by the direction of the vertical or horizontal protrusions/recesses. In addition, the present system eliminates the need for additional structure, such as furring strips, which increase cost and associated with additional material and labor.

The prior art systems that utilize a linear drainage plane contain moisture in a restricted space, which may cause the linear drainage plane to become saturated. Additionally, air flow is limited, which would otherwise facilitate the removal of moisture and drying of the assembly. The omnidirectional pattern of the present invention resists saturation and allows air flow from any direction. The present invention resists plane saturation by allowing moisture to disperse over a large surface area. This has the additional benefit of exposing the moisture to substantially unrestricted air flow, increasing the rate of moisture removal by transferring moisture from the provided space to the moving air.

Siding, trim-board, cladding, or sheathing with an omnidirectional relief pattern formed on one surface may be fabricated from a number of materials, such as, but not limited to, OSB, cement, fiber reinforced cement, gypsum, paper backed gypsum, insulation, foam insulation, wood or wood products, etc.

Patterned Siding

FIG. 1 shows a vented and water control siding system 100 formed as a plurality of vented and water control siding 110. In FIG. 1, siding 110 is secured to a structure 150 formed of an optional weather resistant barrier 156, and a standard sheathing 154 secured to a frame 152. Optional weather resistant barrier 156 may be any barrier, for example building paper, although other barriers or no barrier may be used without departing from the scope herein. In addition, sheathing 154 may be plywood, OSB, particle board, gypsum sheathing, insulation, foam insulation, or any other similar material known in the industry. Frame 152 may be fabricated from wood framing members for example 2×4, 2×6 etc., or metal framing members for example steel studs or the like, or any other framing member know in the industry.

Window 120 shows a back surface 114 of siding 110. Formed on back surface 114 of siding 110 is an omnidirectional relief pattern formed as a grid of raised elements 112. When secured to structure 150, raised elements 112 space back surface 114 of siding 110 away from sheathing 154 or optional barrier 156, thereby creating an omnidirectional drainage plane 116 (arrows shown are exemplary of drainage plane 116 only, and do not limit drainage to any particular direction within plane 116).

In the present example, siding 110 is formed from fiber cement material with raised elements 112 formed on back surface 114 utilizing an embossing process, although other materials and techniques may be used without departing from the scope herein.

Figure 2A:
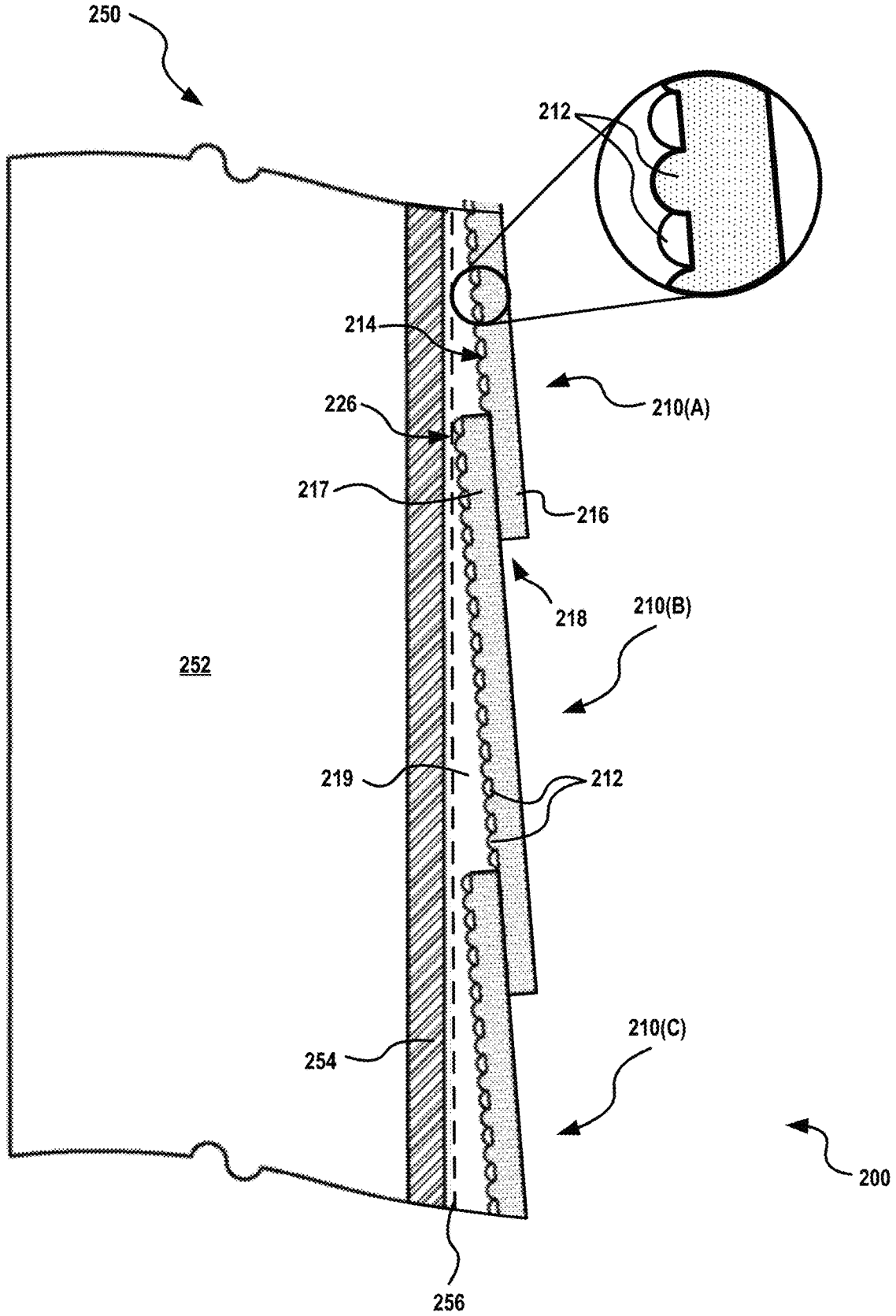
FIG. 2A is a side view of a vented and water control siding utilizing a raised pattern of bumps or dots, overlapping features, and secured to a structure, in an embodiment.

FIG. 2A shows a close-up of system 200, formed of multiple sidings 210(A)-(C), all secured to a structure 250. Similar to structure 150 of FIG. 1, structure 250 is formed of a weather resistant barrier 256, a sheathing 254, and a frame 252. In FIG. 2A, drainage elements are raised elements 212 organized on a grid pattern on a back surface 214 of siding 210, similar to that shown in FIG. 1. A bottom portion 216 of siding 210(A) overlaps a top portion 217 of siding 210(B) creating a seal 218 for sealing a region 219 between siding 210 and structure 250. Region 219 may vent/drain via a drainage plain provided at regions 226 by raised elements 212, such that water, water vapor, and air move substantially freely in region 219.

Figure 2B:
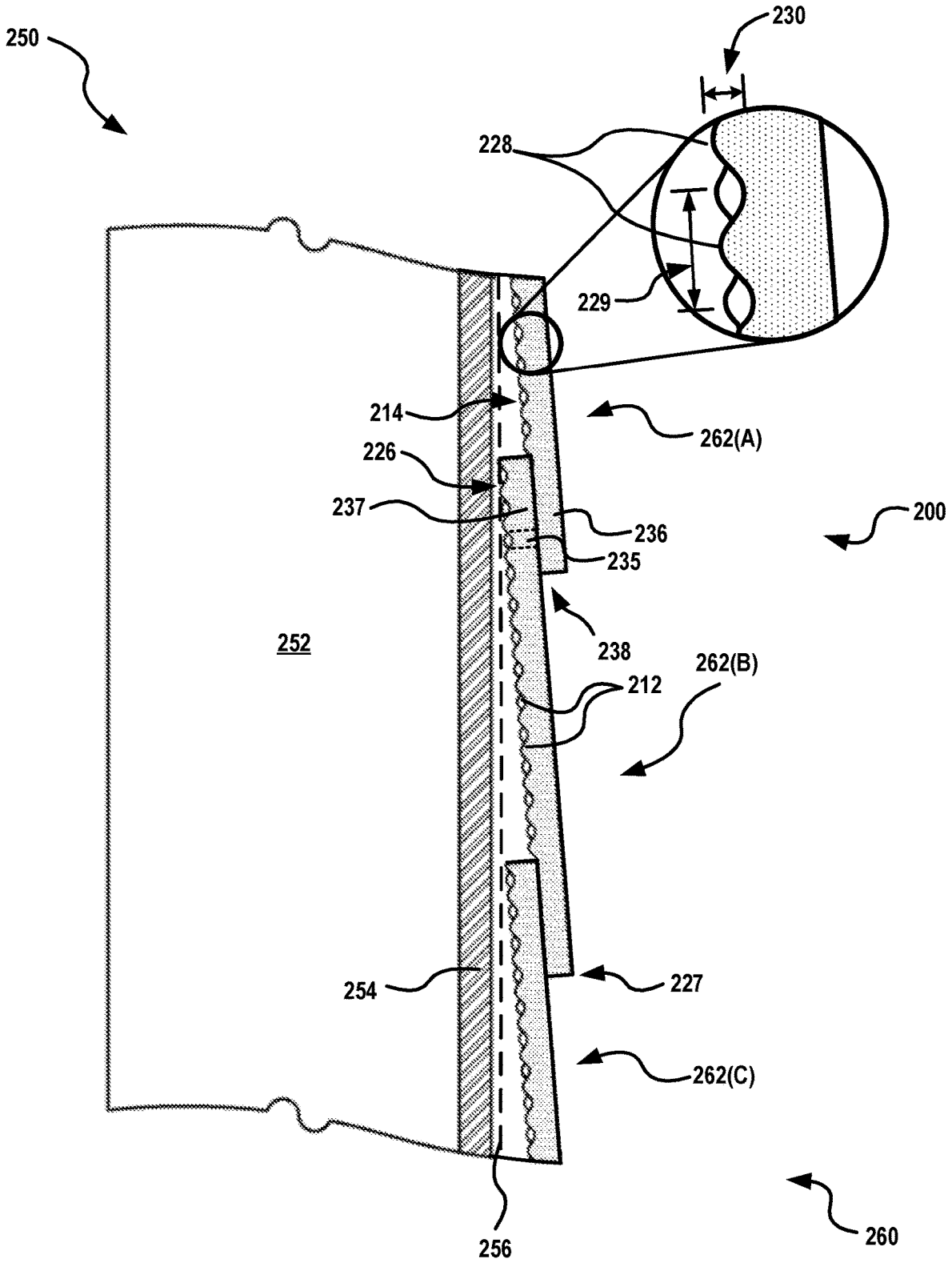
FIG. 2B is a side view of a vented and water control siding utilizing an egg crate/three-dimensional pattern, overlapping features, and secured to a structure, in an embodiment.

FIG. 2B shows an illustrative representation of water control siding system 260, formed of multiple pieces of siding 262(A)-(C), all secured to structure 250, similar to structure 250 of FIG. 2. In the embodiment of FIG. 2B, siding 262(A)-(C) is formed with raised elements 228 organized as an "egg-crate" or other three-dimensional pattern on its interior surface, and a square corner on its bottom outer corner 227.

In the embodiment of FIG. 2B, a bottom portion 236 of an upper siding 262(A) overlaps a top portion 237 of an adjacent, lower siding 262(B) such that a seal 238 is formed between the upper and lower siding. Raised elements 228 form a ventilation and drainage space 226 between each siding 262 and structure 250. Drainage space 226 provides a path for water, water vapor to migrate away from the space between structure 250 and the plurality of siding 262(A)-(C).

In an embodiment, siding 262 is fabricated with a thickness of approximately ½ of an inch, that is, ⅜ of an inch of substantially solid material and ⅛ of an inch for the embossed three-dimensional pattern, and approximately 6 inches wide. The separation distance 229 between the peaks on siding 262's exemplary egg-crate pattern are spaced such that during installation, for example, by fixing to structure 250 with nails or screws, siding 262 is not prone to cracking. An exemplary separation distance 229 is ½ of an inch, although this may vary depending on the type of material used to make siding 262, the thickness of siding 262, etc. In an embodiment, a height 230 of the three-dimensional pattern is optimized to facilitate drainage while maintaining structural integrity. In this embodiment, height 230 is ⅛$^{th}$ of an inch. It will be understood that separation distance 229 and height may be selected to be greater than or less than the measurements disclosed here, for example, to compensate for environments with more or less humidity. Further, the height of the omnidirectional relief pattern elements may taper from the top of the siding or panel to the bottom of the siding or panel, or vice versa. It will be understood that siding 262 may be formed with any industry standard dimension, or any other dimension, without departing from the scope herein. The length of siding 262 may be of any industry standard length, for example, that conforms to fabrication and installation practices.

It will be understood that raised elements 212, 228 may additionally be utilized for alignment purposes during installation of siding 210, 262 by aligning raised elements 212, 228 with the outer top corner of the next lowest, adjacent siding 210, 262, as shown in FIGS. 2A and 2B. For example, the exterior surface of the siding or cladding panel may include a securing hole 235 that corresponds to one or more of the raised elements of the omnidirectional relief pattern. Therefore, when a siding or cladding panel is overlapped with an adjacent siding or cladding panel, the omnidirectional relief pattern on the back side of the upper siding panel aligns with the securing hole on the exterior surface of the lower siding panel.

In the preferred embodiment, siding 110, 210, 262, 322, 372, is fabricated from a cement board or similar fiber-cement composite. In one example of fabrication, the raised features, such as raised elements 112, 212, 228, 312, 328, formed on siding 110, 210, 262, 322, 372 are formed using an embossing processes. Alternatively, siding 110, 210, 262, 322, 372 may be fabricated from any material know in the industry that may benefit from ventilation and moisture drainage between siding and a structure to which it is secured.

Raised features may be a bump or dot pattern similar to that shown in FIGS. 1, 2A, 3A, 4A, 5, 7, 8, 9, 10, 11A and 12. Alternatively, the raised elements may be continuous, for example in an egg-crate pattern, similar to that shown in FIGS. 2B, 3B, 4B, 6, and 11B. Other patterns that facilitate drainage may be used without departing from the scope herein.

In an alternative embodiment, siding, similar to siding 210, 262, may be fabricated to include, within a series of recesses (not shown) at the lower portion of its back surface, a moisture reactive material (not shown), one example of which is bentonite. In the situation where moisture contacts the moisture reactive material, the material expands thereby pushing the lower portion 216, 236 of siding 210, 262 away from the upper portion 217, 237 of the next lowest siding 210, 262. This process creates a drainage channel at location 218, 238 during wet conditions and closes the drainage channel during dry conditions. In this configuration, siding 210, 262 is formed of, with, or includes a semi flexible material, such that the expansion of the moisture reactive material does not fatigue or otherwise damage the siding.

Figure 3A:
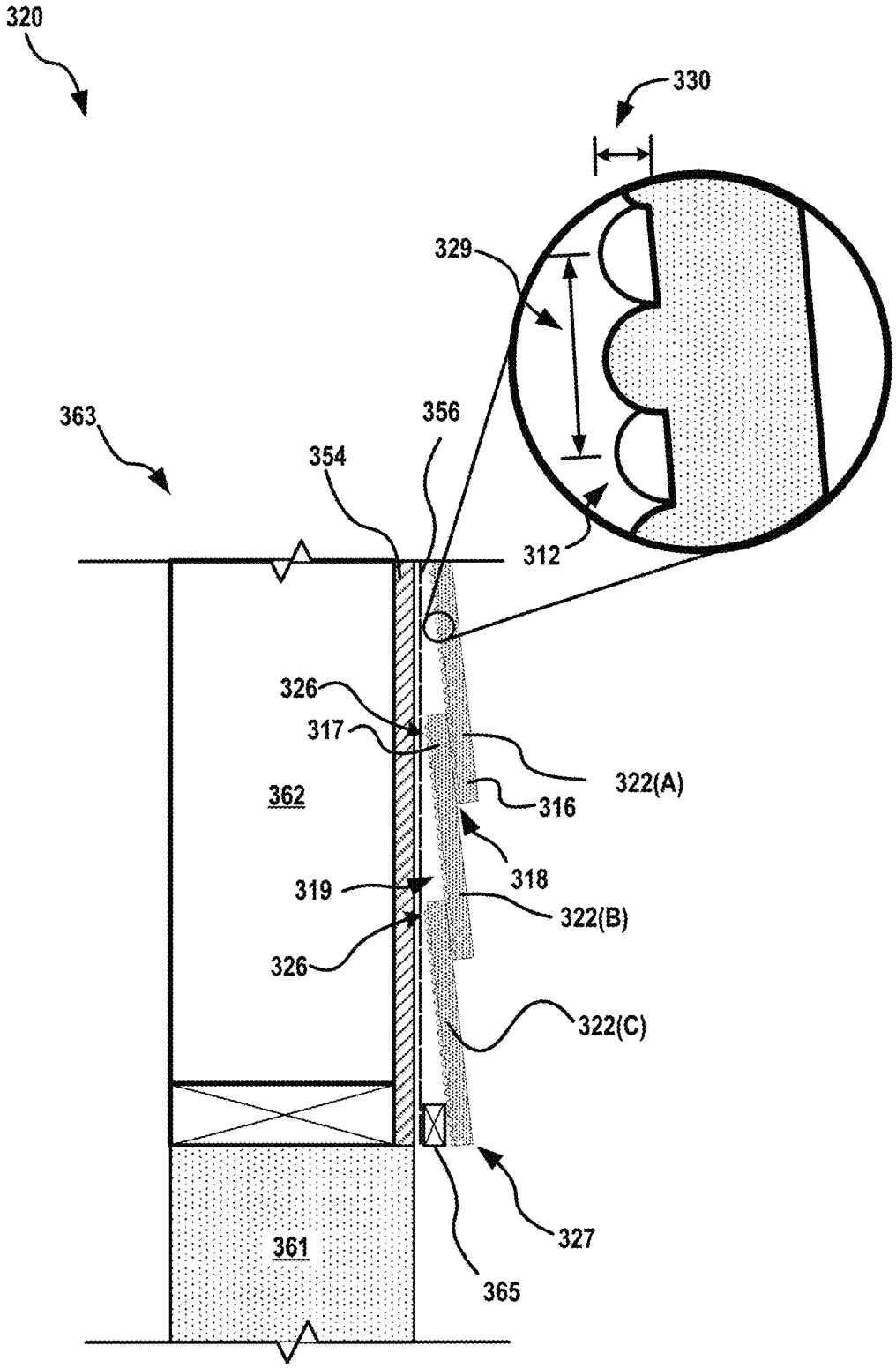
FIG. 3A is a side view of a water control siding utilizing a raised pattern of bumps or dots on its entire back surface, including at areas of overlapping siding, which provides a ventilation and drainage space behind the siding and from the back of the siding to its front, in an embodiment.

FIG. 3A shows a close-up of a system 320, formed of a plurality of siding 322(A)-(C) secured to a structure 363 formed with a weather resistant barrier 356 and a sheathing 354 fixed to a frame 362 that is set on a foundation 361. Frame 362 includes a starter strip 365 for spacing the lower edge of the lowest siding 322(C) away from frame 362. In FIG. 3A, raised features 328 are formed as a raised three-dimensional or egg-crate pattern, similar to FIG. 2A, except raised elements 328 cover the entirety of the back surface of siding 322(A)-(C). Each siding 322 includes raised elements 312 formed on the entire back (unexposed) surface. Raised elements 312 may be formed with a height 330 of ⅛ of an inch and a peak to peak separation distance 329 of about ½ of an inch. As disclosed above, raised elements space siding 322 away from structure 363, thereby generating ventilation and drainage plane 319.

In the embodiment of FIG. 3A, a bottom portion 316 of siding 322(A) overlaps a top portion 317 of the next lowest siding, siding 322(B). Such a configuration provides ventilation to drainage plane 319 and a water and water vapor egress from drainage plane 319 at a location 384. Additionally, moisture may migrate between siding 322(A)-(C) and structure 363 via drainage channels 326.

In an embodiment, starter strip 365 is formed with raised elements (not shown) similar to raised elements 328 to act an additional egress for water or water vapor and to increase ventilation.

Figure 3B:
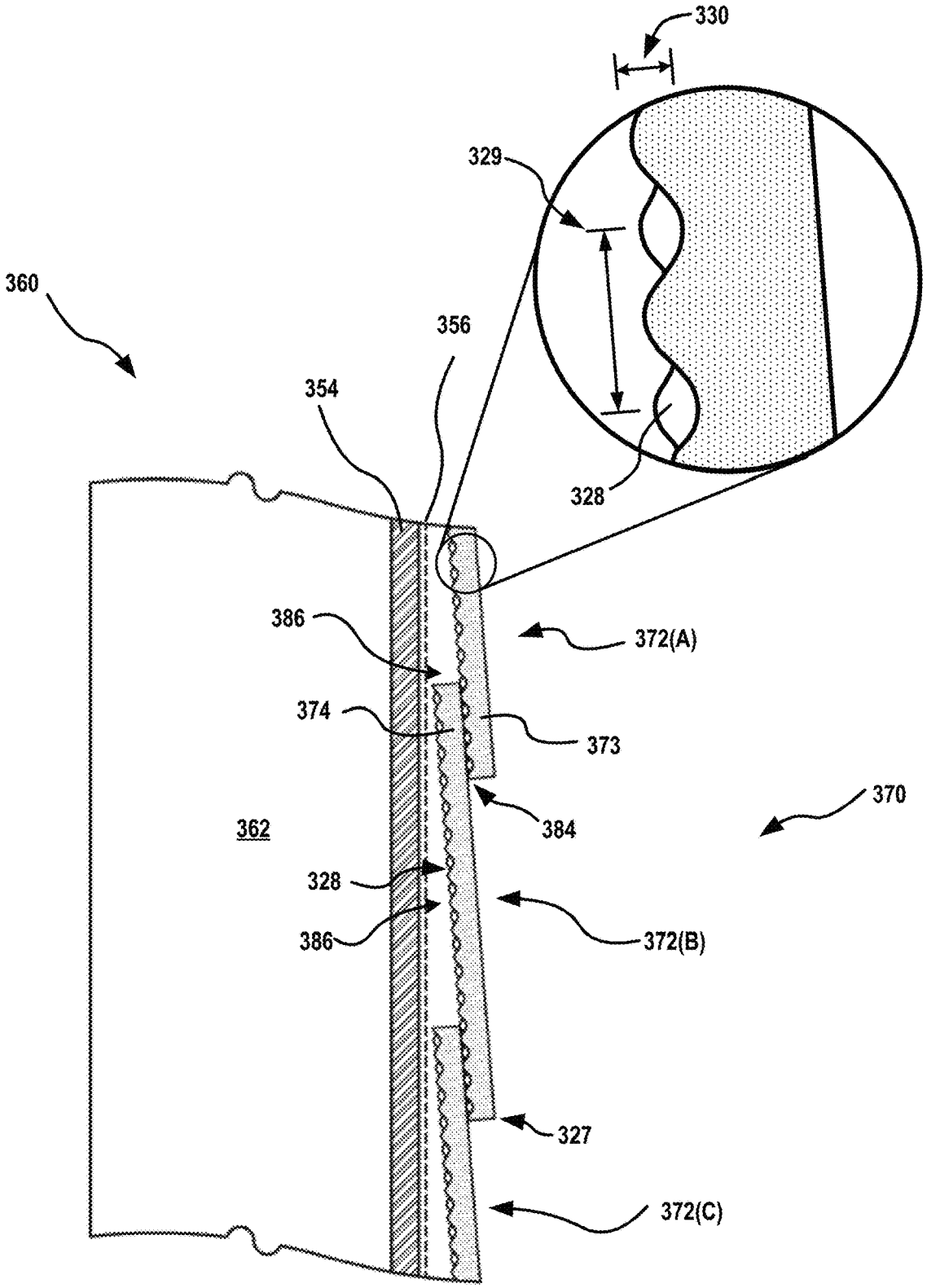
FIG. 3B is a side view of a water control siding utilizing an egg-crate or other three-dimensional pattern on its entire back surface, which provides a ventilation and drainage space behind the siding and from the back of the siding to its front, in an embodiment.

FIG. 3B shows a close-up of a system 370, formed of a plurality of siding 372 secured to a structure 360 having weather resistant barrier 356, sheathing 354, and frame 362. In FIG. 3B, raised features 328 are formed as a raised three-dimensional or egg-crate pattern, similar to FIG. 2B, except raised elements 328 cover the entirety of the back surface of siding 373. In the embodiment of FIG. 3B, a bottom portion 373 of each siding 372(A) overlaps a top portion 374 of the next lowest siding, siding 372(B). Such a configuration provides a front vent at location 384 which provides an inlet for air and an exit for moisture. Additionally, moisture may migrate between siding 372 and structure 360 via drainage channels 386.

Figure 4A:
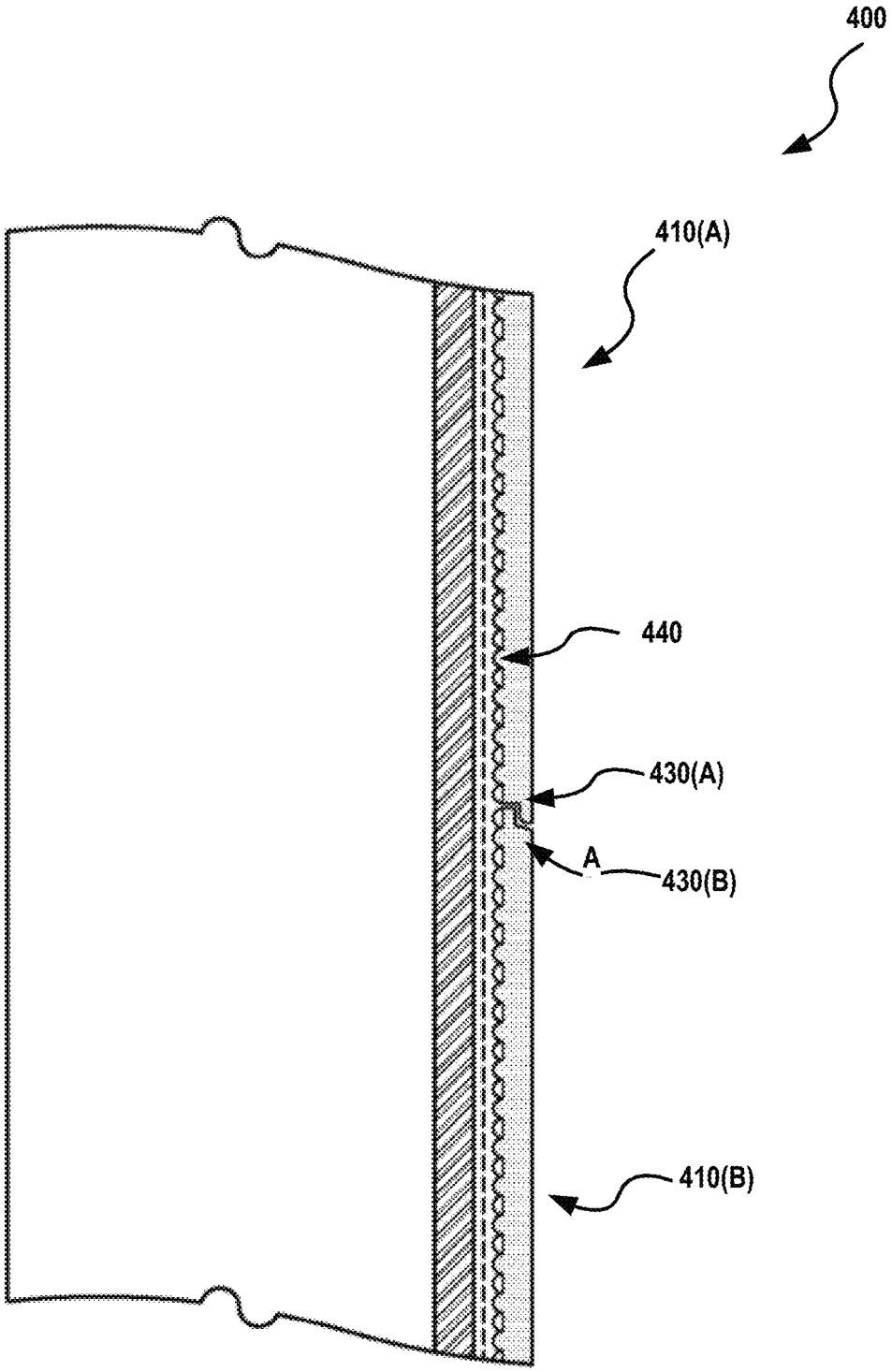
FIG. 4A is a side view of co-planar water control siding utilizing a pattern of bumps or dots on its back surface and secured to a structure, in an embodiment.

In an alternative embodiment, shown in FIG. 4A, siding 410(A) and 410 (B) are formed with overlapping structures 430(A) and 430(B) and having dot patterned raised elements 440 similar to raised elements 212. Overlapping structure 430(A) overlaps overlapping structure 430(B) such that siding 410(A) and siding 410(B) are substantially in the same plane. In addition, overlapping structure 430(A) and 430(B) may also be utilized as alignment features for aligning siding 410(A) with siding 410(B). It will be understood that vented and water control sheathing may utilize the same or similar overlapping structures to the same benefit.

Figure 4B:
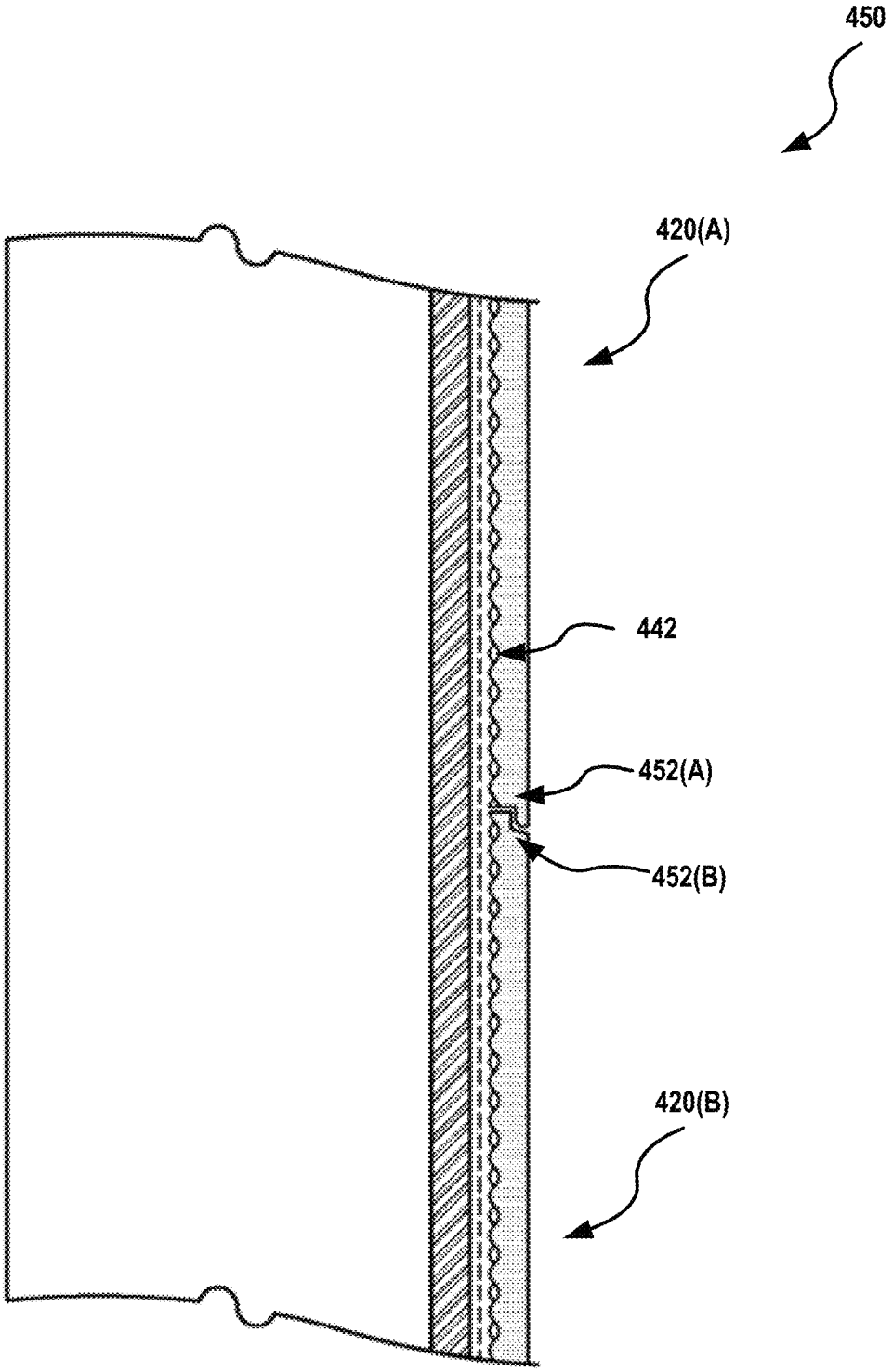
FIG. 4B is a side view of co-planar water control siding utilizing an egg-crate or other three-dimensional pattern and secured to a structure, in an embodiment.

In another alternative embodiment, shown in FIG. 4B, siding 420(*a*) and 420 (*b*) are formed with overlapping structures 452(A) and 452(B) and having egg-crate patterned raised elements 442 similar to raised elements 228 of FIG. 2B. Overlapping structure 452(A) overlaps overlapping structure 452(B) such that siding 420(A) and siding 420(B) are substantially in the same plane. In addition, overlapping structure 452(A) and 452(B) may also be utilized as alignment features for aligning siding 420(A) with siding 420(B). It will be understood that vented and water control sheathing may utilize the same or similar overlapping structures to the same benefit.

Figure 5:
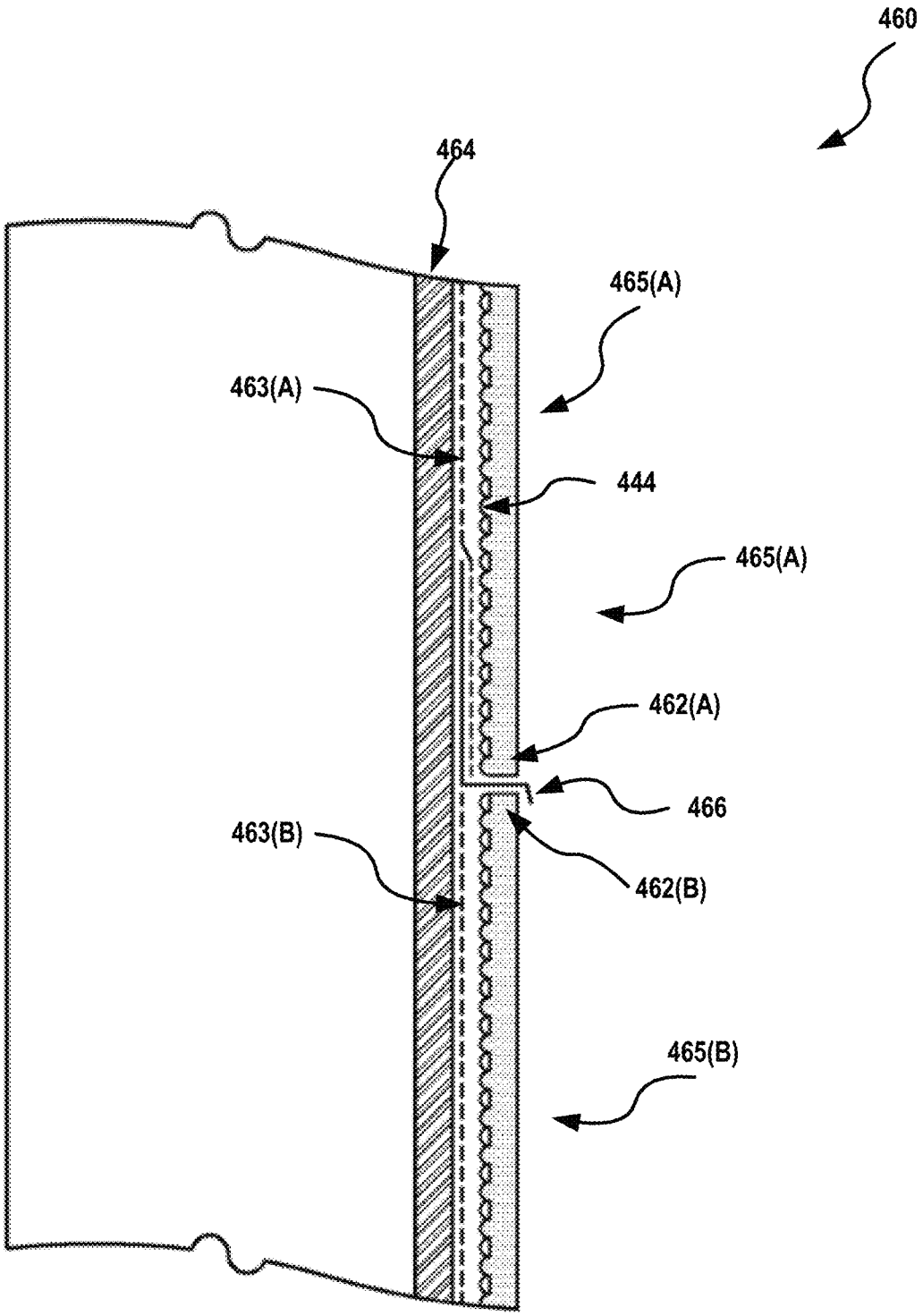
FIG. 5 is a side view of co-planar water control siding utilizing a raised pattern of bumps or dots, with flashing located in a butt joint formed at the joint between two sidings, and secured to a structure, in an embodiment.

In another embodiment, shown in FIG. 5, vented and water control siding 465(A) and 465(B) are formed with substantially flat surfaces 462(A), 462(B) and having dot patterned raised elements 442 similar to raised elements 440 of FIG. 4(A). Siding 465(A), 465(B) are butt jointed with a flashing 466 therebetween such that siding 465(A) and 465(B) are substantially in the same plane. Flashing 466 is secured to a sheathing 464, for example by nails or screws (not shown), with a weather resistant barrier 463(A) overlaid on top of the upper portion of flashing 466. This configuration provides a path of egress for moisture trapped between weather resistant barrier 463(A) and siding 465(A) via flashing 466 at the butt joint. It will be understood that vented and water control sheathing may utilize the same or similar overlapping structures to the same benefit.

Figure 6:
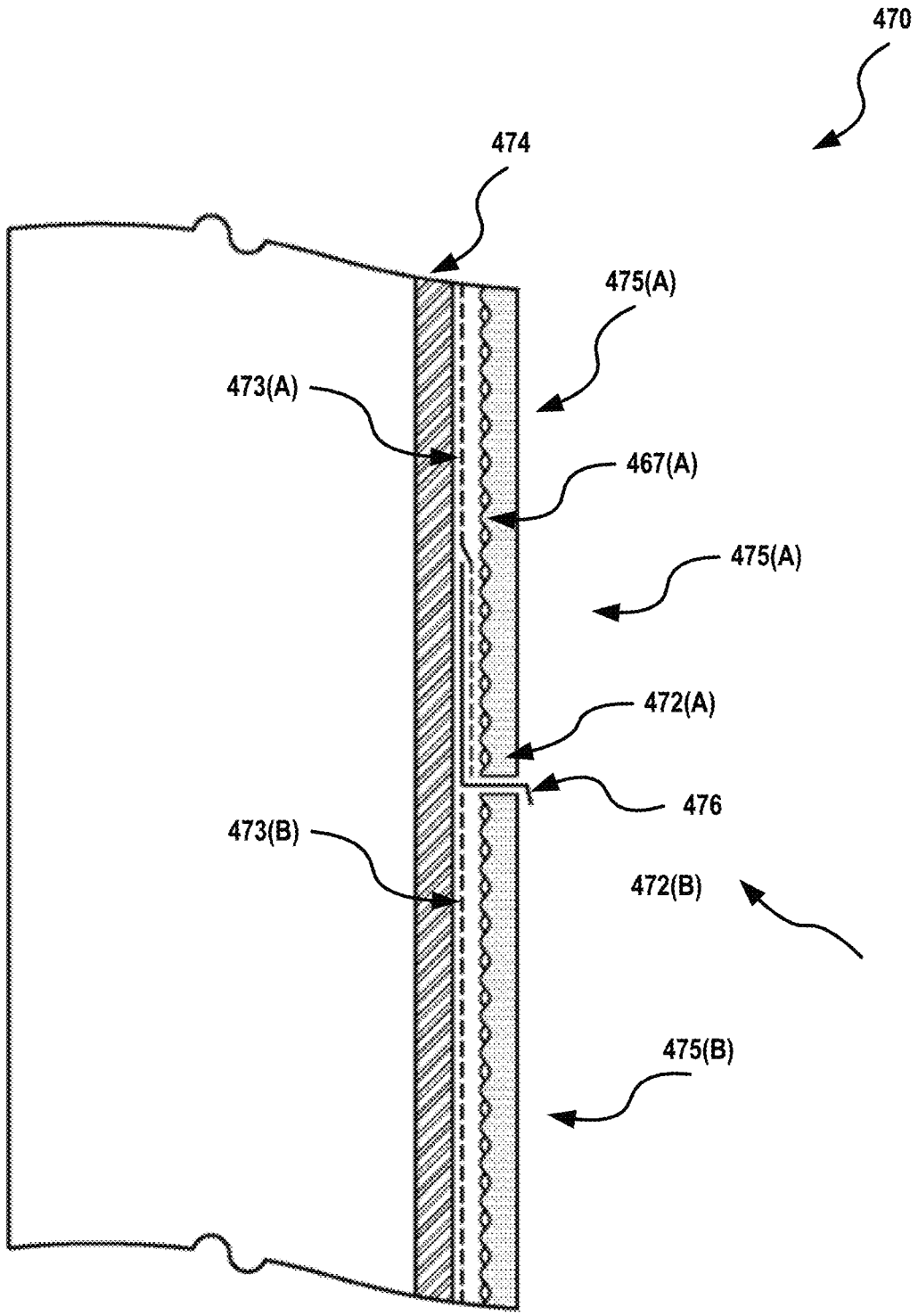
FIG. 6 is a side view of co-planar water control siding utilizing an egg-crate or other three-dimensional pattern, with flashing located in a butt joint formed at the joint between two sidings, and secured to a structure, in an embodiment.

In another embodiment, shown in FIG. 6, vented and water control siding 475(A) and 475(B) are formed with substantially flat surfaces 472(A), 472(B) and having egg-crate patterned raised elements 467 similar to raised elements 442 of FIG. 4(B). Siding 475(A), 475(B) join at a butt joint with a flashing 476 therebetween such that siding 475(A) and 475(B) are substantially in the same plane. Flashing 476 is secured to a sheathing 474, for example by nails or screws (not shown), with a weather resistant barrier 473(A) overlaid on top of the upper portion of flashing 476. This configuration provides a path of egress for moisture trapped between weather resistant barrier 473(A) and siding 475(A) via flashing 476 at the butt joint. It will be understood that vented and water control sheathing may utilize the same or similar overlapping structures to the same benefit.

Patterned Panels

It will be understood that panels may be fabricated from any number of materials that accepts a pattern, for example, by embossing or patterning, such as Oriented Strand Board (OSB), cement board, fiber-cements board, Medium Density Fiberboard (MDF), Gypsum sheathing, insulation, foam insulation, or any other material. Even though the present invention is suitable for use with any of many products, the invention will be disclosed in the context of OSB sheathing from this point forward.

Figure 7:
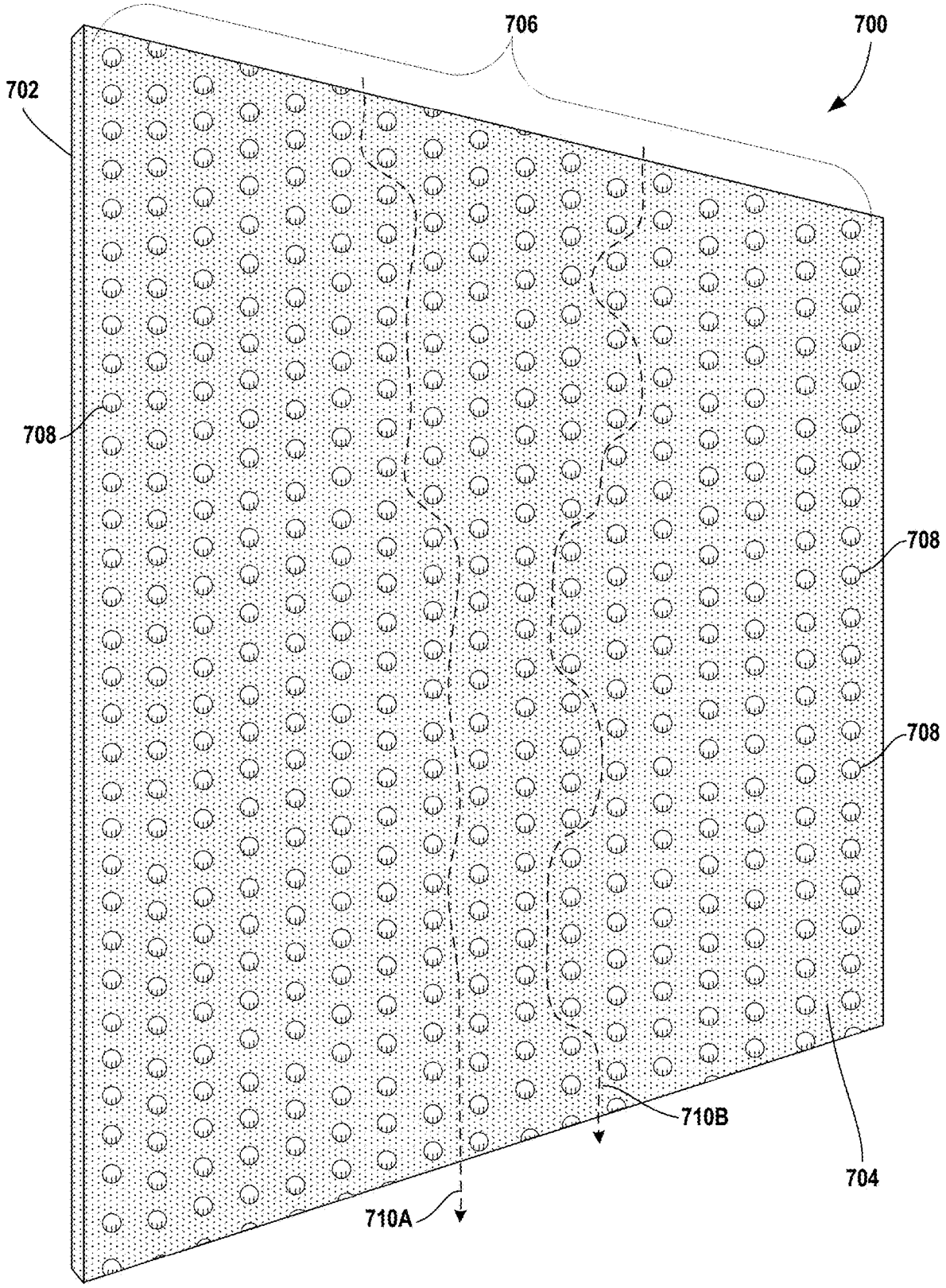
FIG. 7 is a perspective front view of a panel of vented and water control sheathing utilizing a raised pattern of bumps or dots, according to an embodiment.

FIG. 7 shows a panel 702 of water control OSB sheathing 700. Panel 702 is made of cross-directional strips or strands of wood, and is not limited to any particular type of wood or size of strip/strand. A front or outer face 704 includes a non-directional grid or pattern 706 of raised surface features 708. Other patterns may be used, for example an egg-crate pattern similar to egg-crate pattern shown in FIG. 3B, without departing from the scope herein. A plurality of drainage and ventilation channels 710, indicated by dashed lines, are formed between raised surface features 708. It will be appreciated that although only two channels 710A and 710B are shown, air or moisture is not limited to the particular paths shown between surface features 708. A lower/inner face 712 opposite outer face 704 (see FIG. 8) may be flat, in order to facilitate attachment with the frame of a building. The non-directional nature of pattern 706 allows a user to cut and hang OSB sheathing 700 at any desired orientation without sacrificing drainage or ventilation, as channels 710 through surface features 708 exist between outer face 704 and an exterior finish (e.g. siding or cladding) regardless of how panel 700 may be rotated within a vertical plane. Exterior finish may also be roofing materials, such as shingles, as discussed below with reference to FIG. 18. Likewise, channels 710 allow for circulation and/or drainage whether panel 700 is hung vertically or at an angle.

Figure 8:
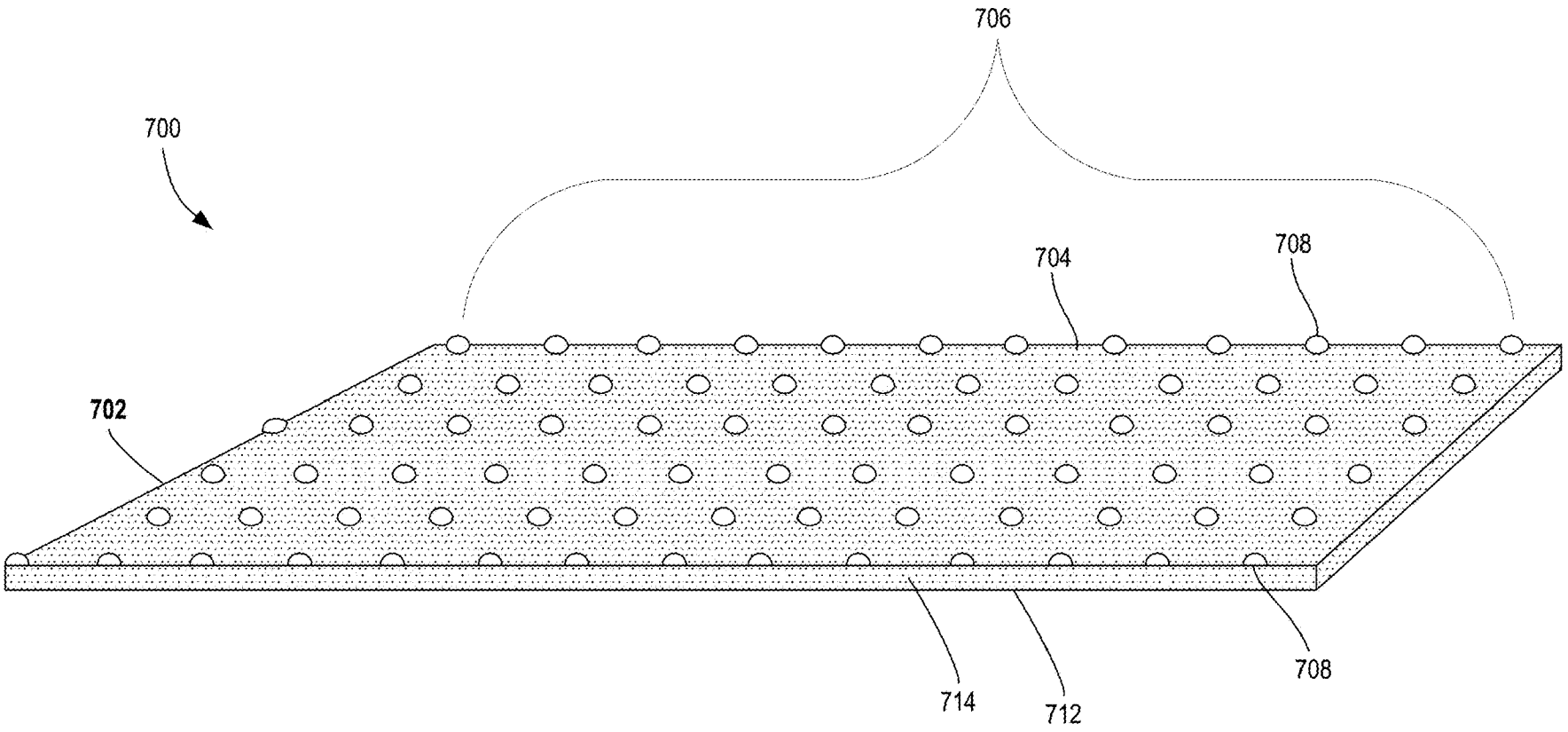
FIG. 8 is a perspective side/end view of the panel of FIG. 7.
Figure 9:
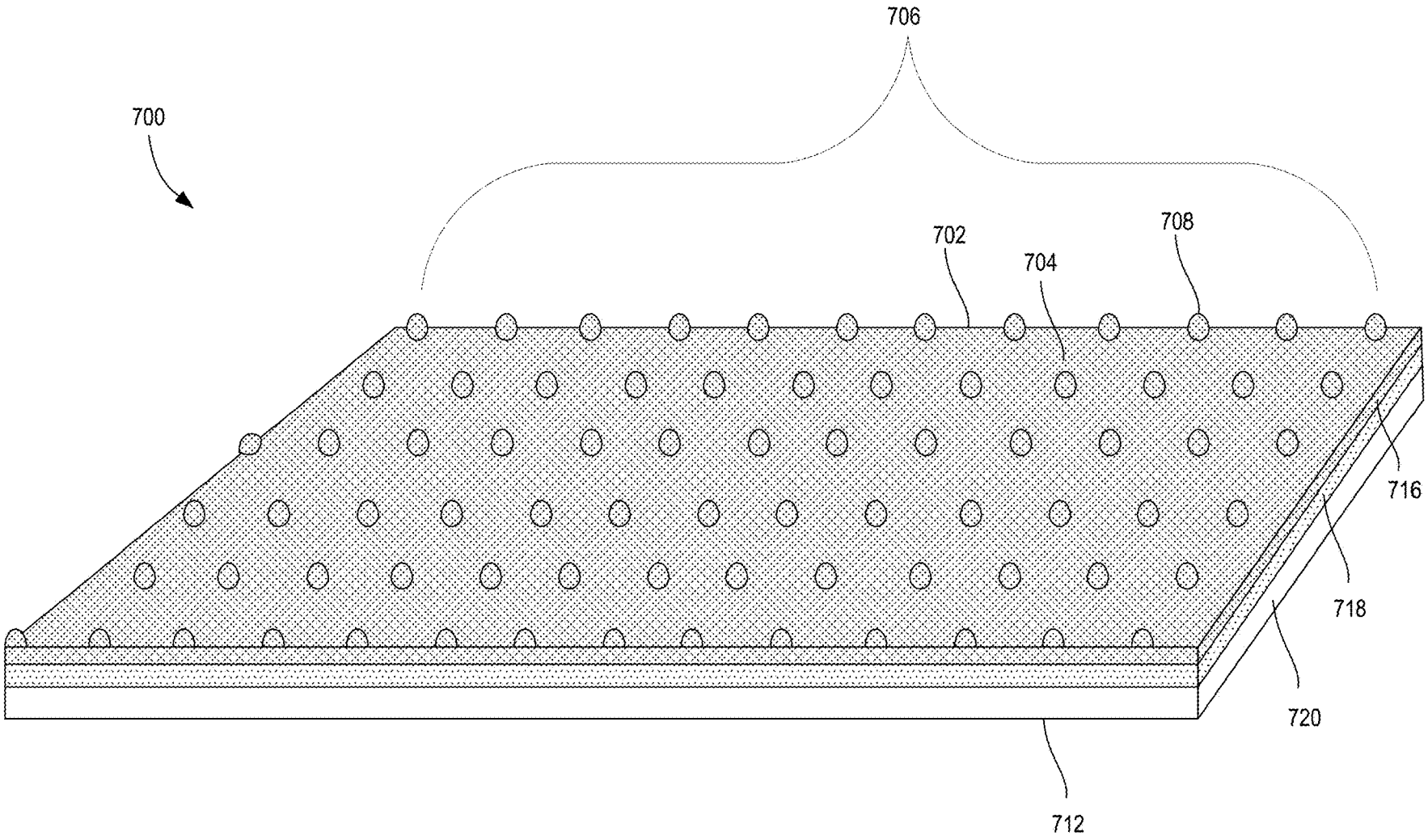
FIG. 9 is a perspective side/end view of a panel of vented and water control sheathing, according to an embodiment.
Figure 10:
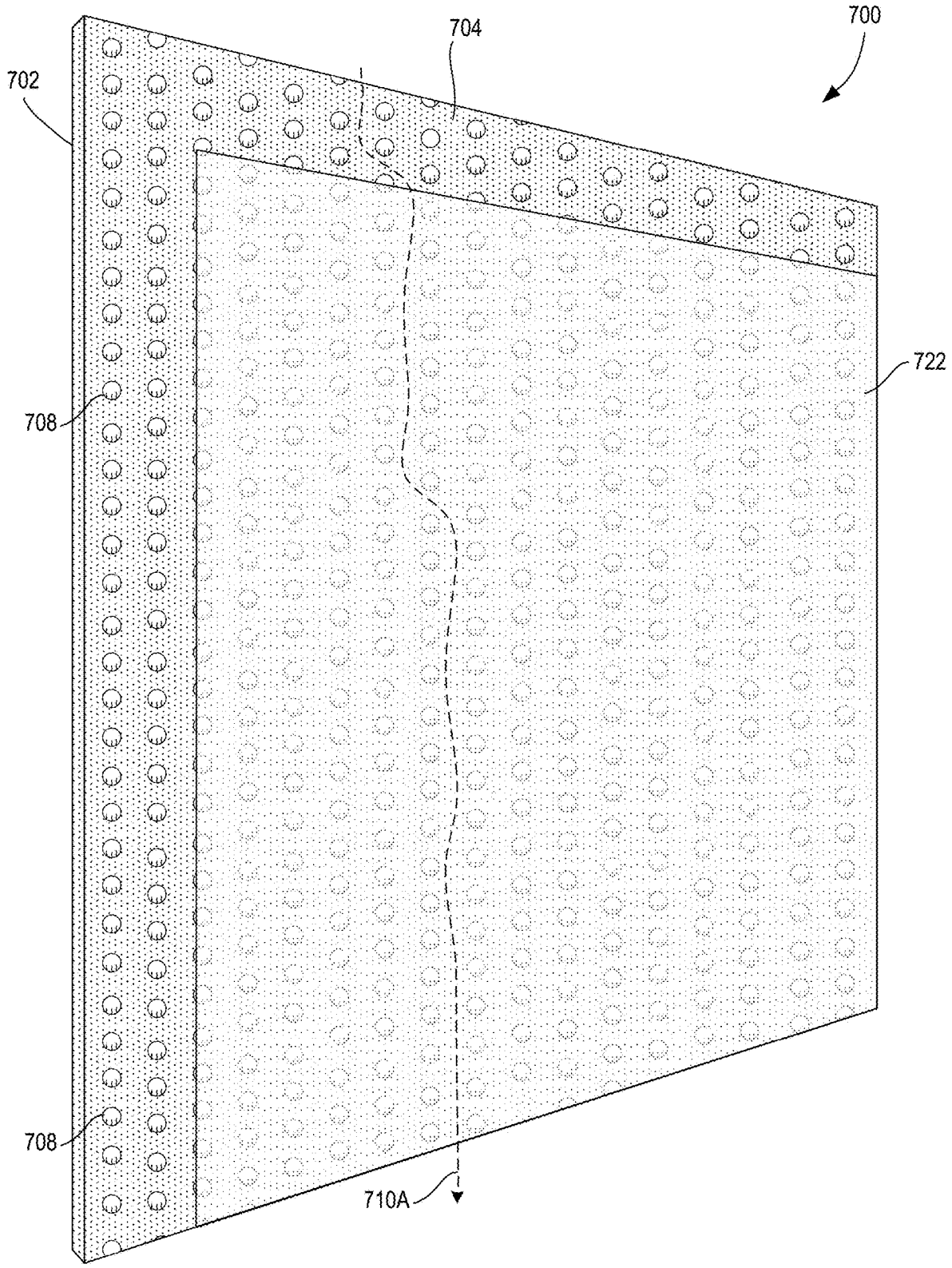
FIG. 10 is a perspective front view of the panel of FIG. 7 including an applied water barrier, according to an embodiment.

As shown in FIG. 8, panel 702 includes a core 714 between outer and inner faces 704 and 712. Panel 702 may be formed of a uniform strip/strand size, or panel 702 may incorporate a variety of strand sizes. In one aspect, as shown in FIGS. 9 and 11, a core may be stratified such that an outer layer or portion 716, the outer face of which is face 704, is formed of finer (i.e., smaller) wood strands than the remainder of the core. FIGS. 9 and 11 illustrate three layers 716, 718 and 720 forming the core. Layer 720 is formed of the largest strands; layer 718 is formed of finer strands, and layer 716 is formed of still finer strands. It will be appreciated that although a three-layer the core is shown, this is for illustrative purposes only. More or fewer layers may be included in the core; furthermore, layers may not be sharply defined as illustrated, but rather may flow into one another in gradient fashion.

Figure 11A:
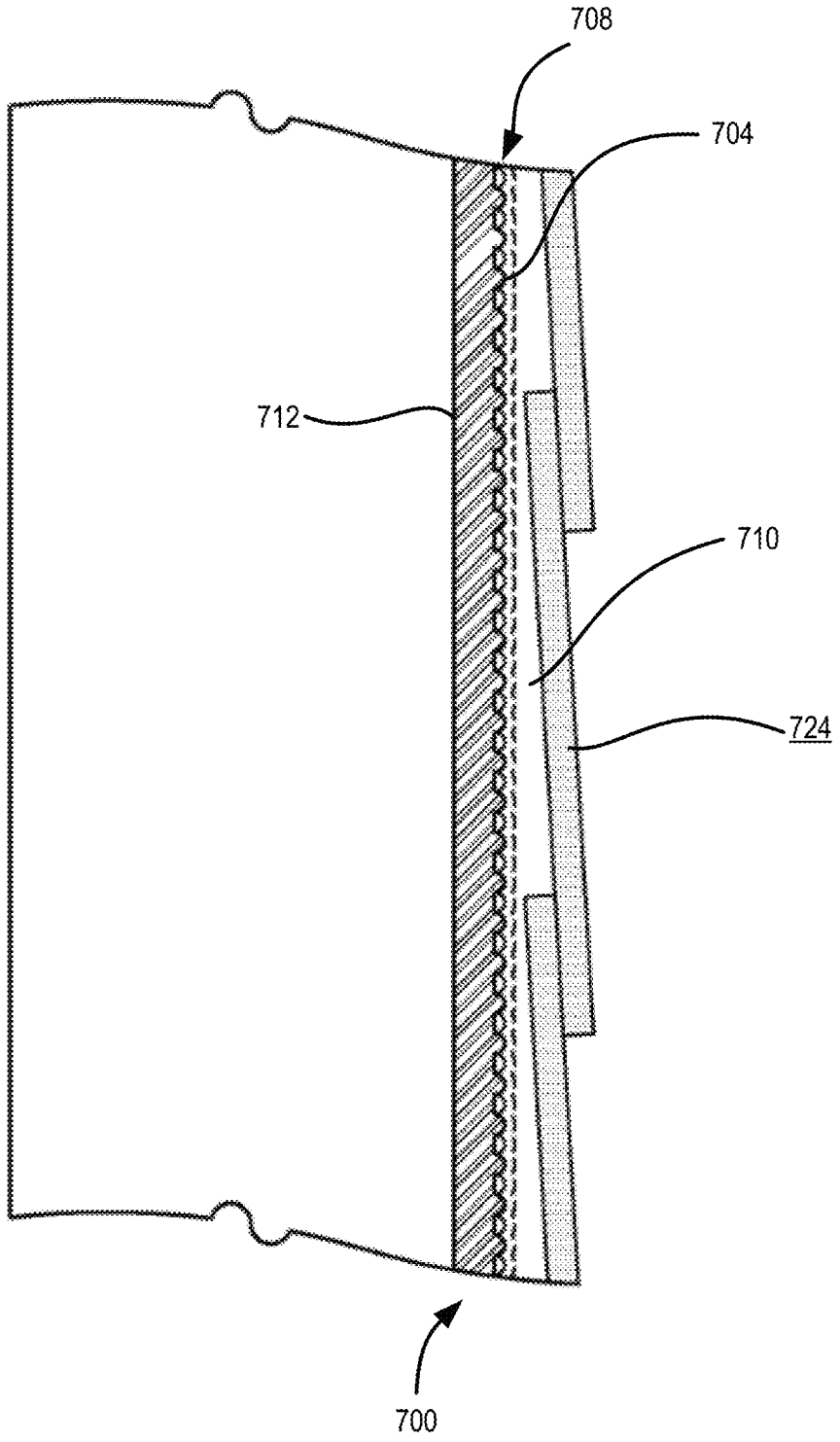
FIG. 11A is a side view of the panel of FIG. 10, attached with an exterior finish or cladding, according to an embodiment.
Figure 11B:
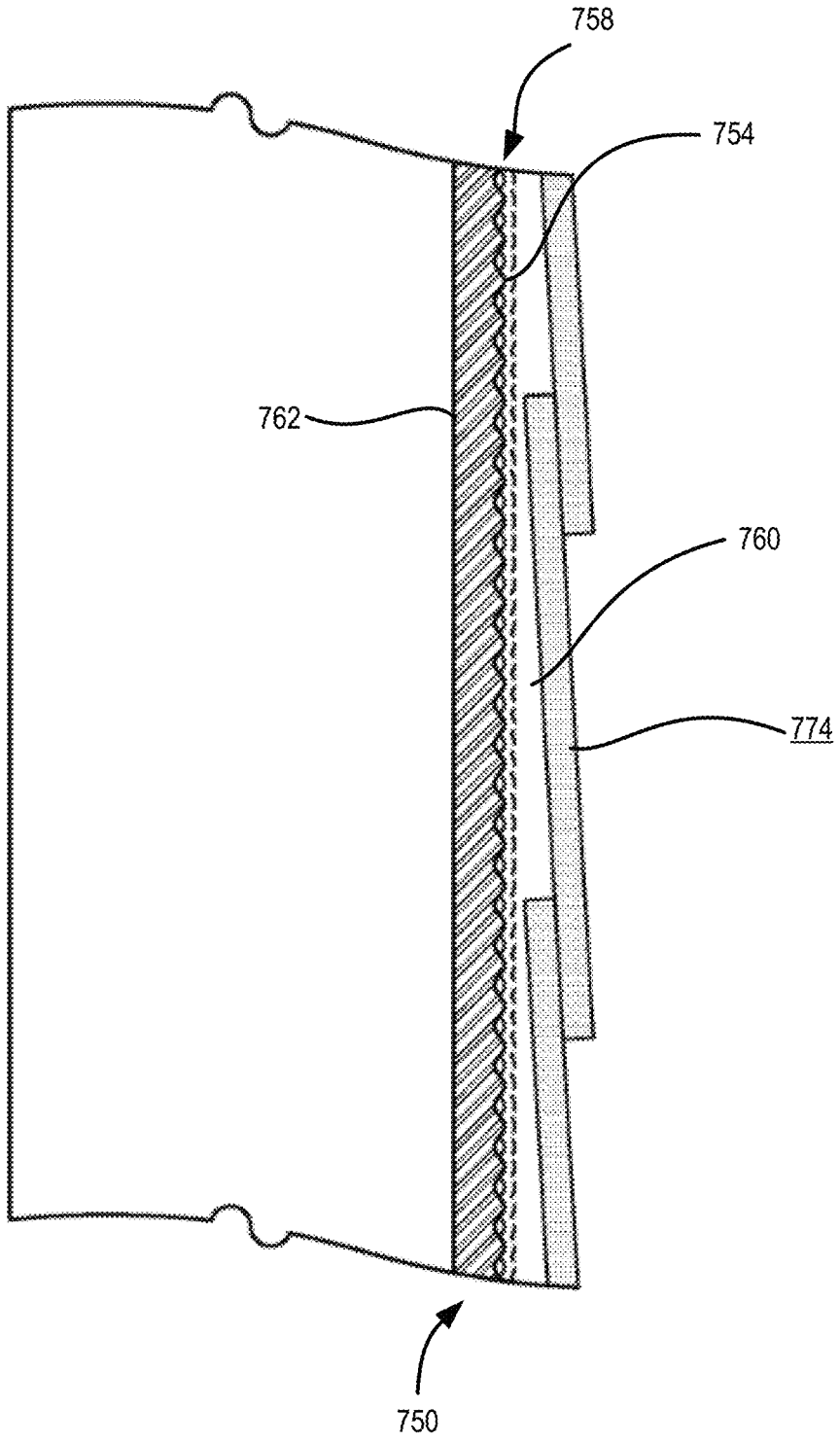
FIG. 11B is a side view of a panel of vented and water control sheathing utilizing an egg-crate or other three-dimensional pattern, attached with an exterior finish or cladding, according to an embodiment.
Figure 12:
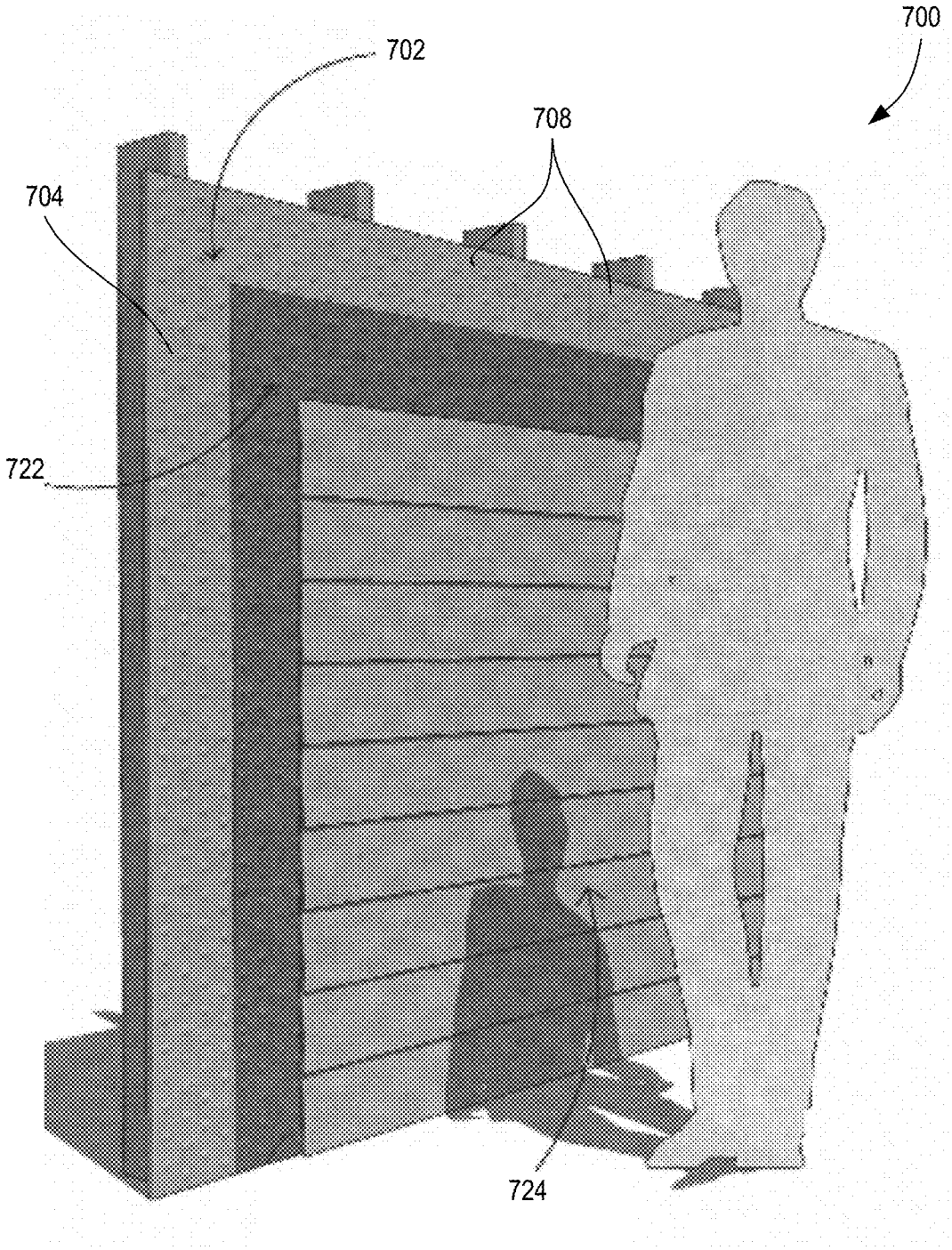
FIG. 12 is a perspective front view of a panel of vented and water control sheathing attached with a building frame, including a water barrier and attached with an exterior finish, according to an embodiment.

Fine wood strands of upper layer 716 facilitate stamping or embossing surface features 708 into outer face 704, as further described with respect to FIG. 13, below. As illustrated in FIGS. 11(A) and (B), surface features 708, 758 provide connection points for attaching an exterior finish, such as siding or cladding, (shown as siding 724, 774, although OSB sheathing 700, 750 is not limited to use with siding) to OSB sheathing 700, 750. Surface features 708, 758 further provide an offset between face 704, 754 and a back surface of siding 724, 774, thus creating ventilation and/or drainage channels 710,760 between siding 724, 774 and OSB sheathing 700, 750. Channels 710, 760 beneficially allow for air to circulate beneath siding 724, 774 or other exterior finish, such as siding or cladding, allowing the OSB sheathing and siding to breathe, thus reducing condensation or other moisture buildup. In addition, channels 710, 760 allow any moisture deposited between the finish and the OSB sheathing to drain to the ground. Vented and water control OSB sheathing 700, 750 thereby reduces or eliminates problems such as edge swelling, mold and other moisture related problems. It will be appreciated that seams between panels 712, 762 may require treatment with sealant tape, or other moisture barrier, as is known in the art.

Sheathing 700 may also be formed from other materials including, but not limited to, fiber reinforced cement, gypsum, paper backed gypsum, insulation, foam insulation, wood, metal, or other materials. For example, in one embodiment, a foam panel is press molded one surface to include features (similar to features 708). Upon insulation, the features are installed facing exteriorly from the structure to provide an omnidirectional drainage and ventilation path for moisture and air between the sheathing and attached siding, cladding, or trim-board.

Sheathing 700 may also include other features discussed herein. For example, sheathing 700 may include overlapping structures (such as structures 430(A) and 430(B), and 452 (A) and 452(B), discussed above) such that adjacent panels of sheathing 700 overlap and are substantially in the same plane when installed. Alternatively, sheathing 700 may be butt jointed with adjacent sheathing panels and include flashing (such as flashing 466) therebetween such that adjacent sheathing panels are substantially in the same plane when installed. In addition, sheathing 700 may include an omnidirectional relief pattern on both a front and back side. By including omnidirectional relief pattern on both sides, sheathing 700 will provide an omnidirectional drainage and ventilation path on the exterior facing side. Also, the interior facing side will reduce thermal bridging where the panel meets the stud. Thus, the omnidirectional relief pattern on the internal side will increase the energy efficiency of the structure, particularly where steel studs are used in the construction of the structure.

A water-resistant barrier 722 (FIGS. 10 and 12) may be applied to outer face 704 and surface features 708. In one aspect, water-resistant barrier 722 is a hydrophobic barrier and is applied as a fluid membrane. Barrier 722 may therefore be spray-coated, painted or rolled onto outer face 704 and surface features 708, or panel 702 may be dipped into liquid barrier 722. In another aspect, barrier 722 is applied to outer face 704 prior to stamping or embossing panel 702 with surface features 708.

Figure 13:
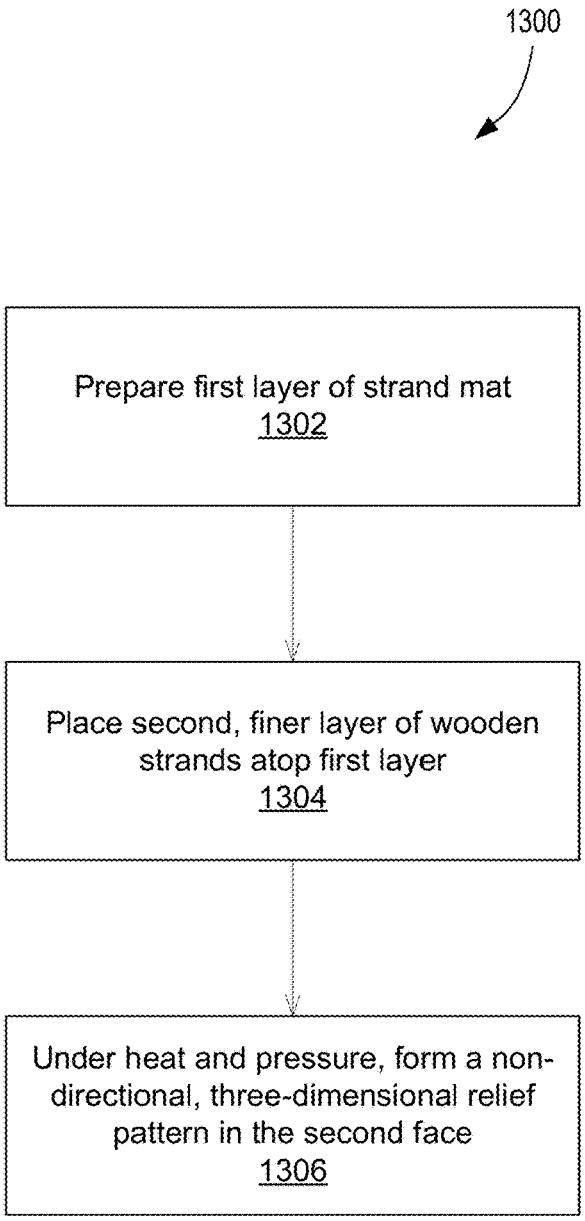
FIG. 13 is a flowchart illustrating a method of manufacturing vented and water control sheathing, according to an embodiment.

FIG. 13 illustrates one method 1300 for manufacturing water control OSB sheathing. A first, lower/inner layer of a wood strands is prepared, in step 1302. A second, finer layer of wooden strands is placed atop the first layer, in step 1304. In one aspect, the second, finer layer is machine-positioned atop the first layer, which is also applied (i.e., to a conveyor belt or other platform) by machine. The strand mat is subjected to heat and pressure, and an omnidirectional relief pattern is formed in the second, outer face, in step 1306. In one aspect, pattern 706 is formed in face 704. The OSB panel formed via method 1300 may be coated with a water-resistant barrier, either before or after forming the omnidirectional relief pattern in the outer face. In alternate embodiments, sheathing, siding, trim-board, or cladding may be formed as stamped, embossed, or otherwise formed with a raised surface omnidirectional pattern that provides an air space for ventilation and a drainage plane.

Figure 18:
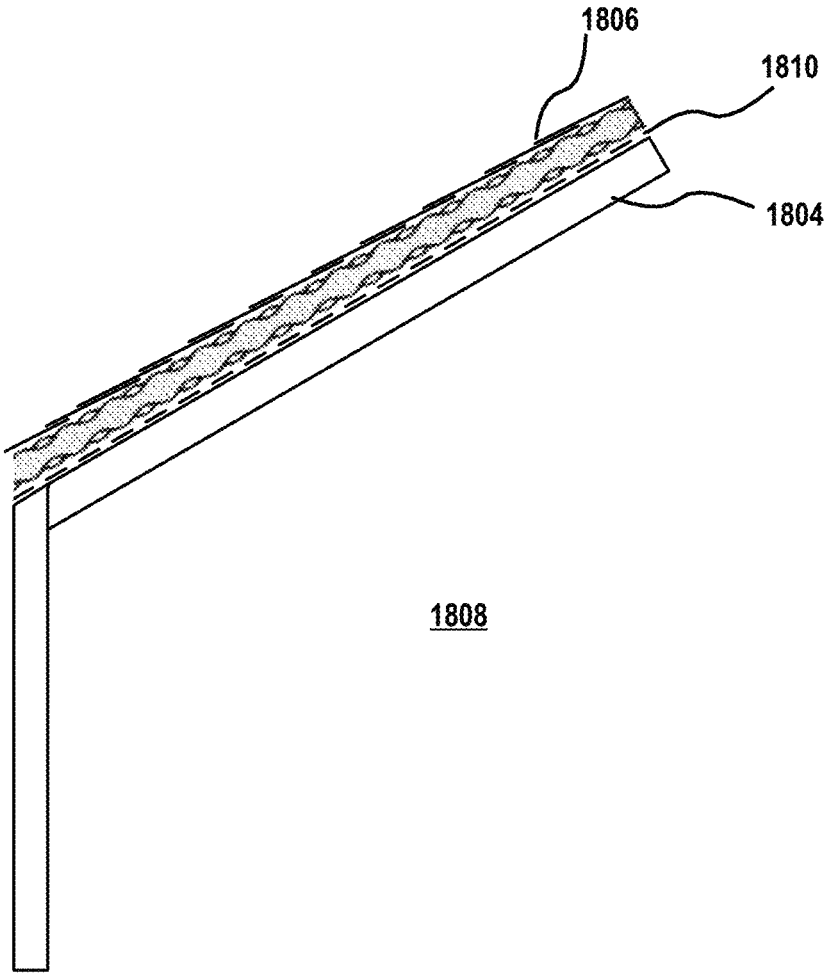
FIG. 18 depicts sheathing when utilized as roof sheathing and installed on rafters of structure, in one embodiment.

FIG. 18 depicts sheathing 1802 when utilized as a roof sheathing and installed on rafters 1804 of structure 1800, in one embodiment. Sheathing 1802 includes an omnidirectional relief pattern on each side of sheathing 1802. The omnidirectional relief pattern may be a grid pattern of raised bumps as discussed above (e.g. raised dots, egg crate pattern, or raised elements such as a pyramid, squares, rectangles, etc.). The pattern on the outer surface provides an omnidirectional drainage and ventilation path between sheathing 1802 and roofing shingles 1806. Furthermore, the omnidirectional relief pattern on the exterior surface provides a non-slip surface during installation or maintenance of the roof. The pattern on the inner surface provides ventilation path between an interior space 1808 and the exterior of the structure. Roof ventilation is a code requirement when ceilings are attached to the roof rafters or framing below. Weather resistant barrier 1810 may be included between sheathing 1802 and rafters 1804, or also between sheathing 1802 and shingles 1806, or both.

Figure 19:
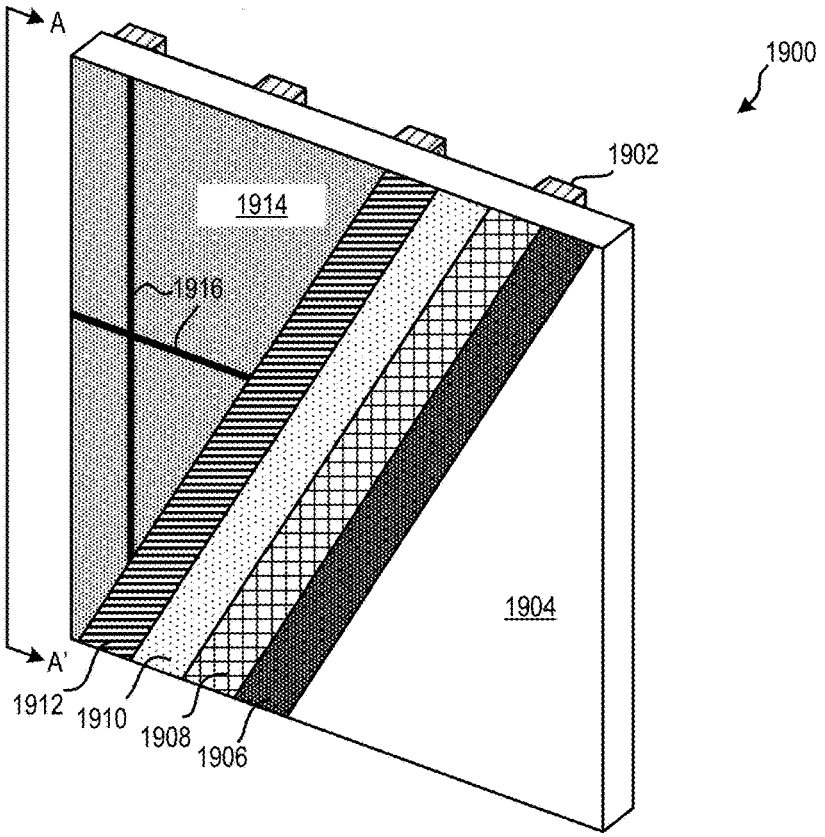
FIG. 19 (PRIOR ART)
FIG. 19 depicts a prior art stucco wall.
Figure 20:
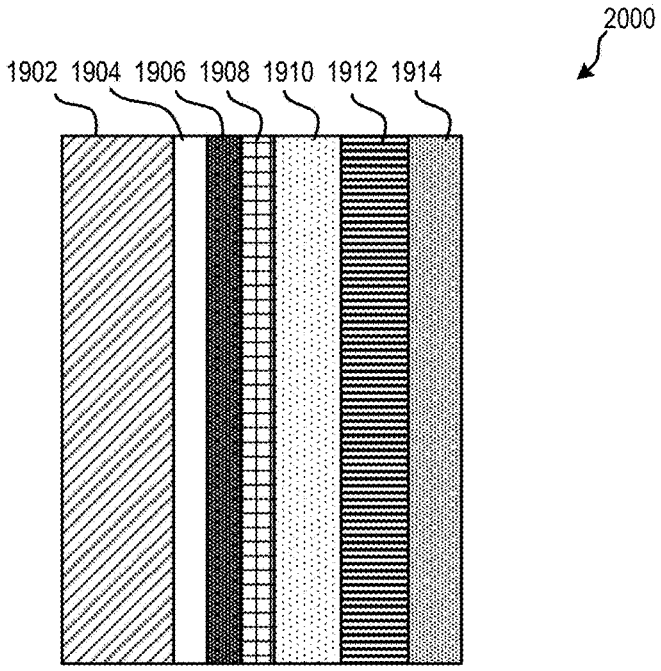
FIG. 20 (PRIOR ART)
FIG. 20 depicts a cross section along line A-A' of the prior art stucco wall of FIG. 19.

The above described panels and siding may be used within a stucco (also referred to as exterior plaster, or exterior cement plaster) finish. FIG. 19 depicts a prior art stucco wall 1900. FIG. 20 depicts a cross section 2000 along line A-A' of the prior art stucco wall of FIG. 19. FIGS. 19 and 20 are best viewed together with the following description.

Stucco wall 1900 includes wall framing 1902. Sheathing 1904 is coupled to framing 1902 to provide structural support and backing to the cladding or siding and to transmit loads to the structural framing. Therefore, sheathing 1904 may be defined as a structural wood panel or structural board. One example of such sheathing 1904 is described in U.S. Patent Application Publication No 2009/0113838 to Paulsen, which shows "sheathing 502" attached to "framing 501" in FIG. 5 thereof.

To build a typical three-coat stucco finish on wall 1900, a weather barrier 1906 may be applied to sheathing 1904. Then a lath 1908 may be applied to weather barrier 1906. In some instances, lath 1908 may be applied directly to sheathing 1904. Lath 1908 may be welded wire lath, woven wire lath, expanded metal lath, flat rib lath, plastic lath, or other similar materials that the stucco material is keyed into. The stucco is applied to the metal lath to fully key the metal lath in the stucco. Keyed into the lath 1904 is a first stucco coat 1910. This first stucco coat 1910 is often referred to as a 'scratch coat'. On top of first stucco coat 1910 is a second stucco coat 1912. This second stucco coat 1912 is often referred to as a 'brown coat'. Then, a third stucco coat 1914 is applied to second stucco coat 1912. This third stucco layer 1914 is often referred to as the 'finish' coat, and may be painted or otherwise colored. Within the stucco layers 1910, 1912, 1914 may be one or more vertical or lateral control joints 1916.

Wall 1900 has many disadvantages. First, the labor to apply the sequential coats of stucco is time consuming and costly. Moreover, each individual first, second, and third stucco coat 1910, 1912, 1914 must be applied individually, and then allowed to cure in accordance with a specific standard and building code requirement before the next coat can be added. The successive coats of stucco fill cracks in the coats below and produce a finish with less visible cracking. The sequential layers of cement plaster, each contain various amounts of aggregate and cement to cover cracks and imperfections in the prior coat of cement plaster. The present embodiments disclosed herein solve these disadvantages and reduces labor costs and greatly reduces or eliminates the curing time of successive coats of cement plaster.

Figure 21:
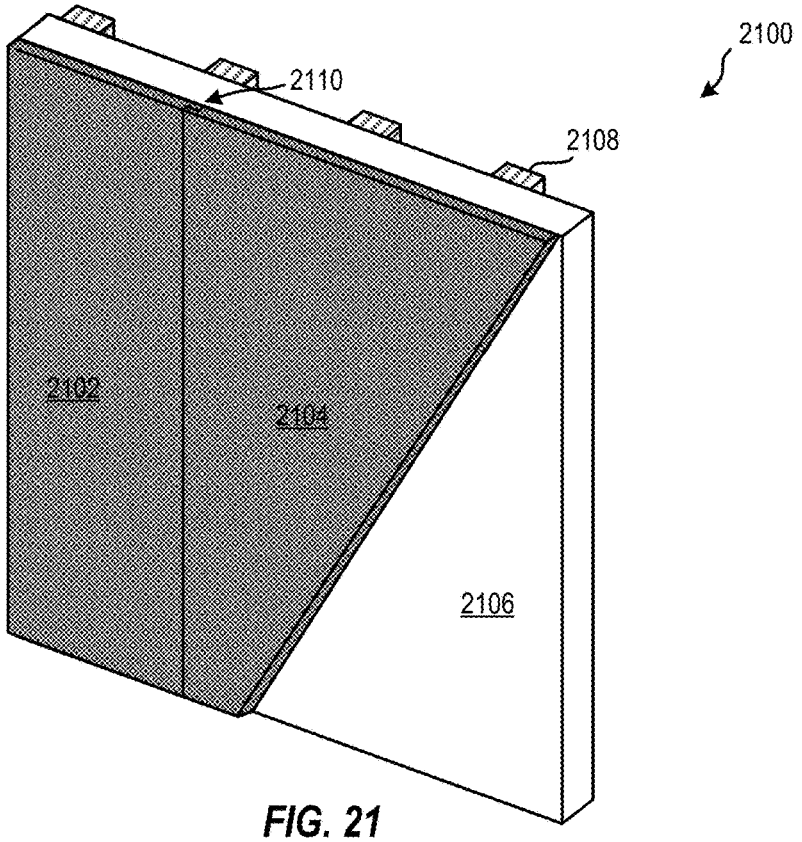
FIG. 21 depicts a simplified system for providing an exterior finishing, in embodiments.

FIG. 21 depicts a simplified system 2100 for providing an exterior finishing, in embodiments. System 2100 includes a first and second exterior panel 2102, 2014, respectively that overlays a structural board 2106. Structural board 2106 is coupled to the framing 2108 of a structure. Structural board 2106 is similar to sheathing 1904, discussed above, in that structural board 2106 provides structural support and backing to the cladding or siding and transmits loads to the structural framing. Exterior panels 2102, 2104, on the other hand, may form a non-structural component of the finishing of the structure.

Exterior panels 2102, 2104 may be any of the above discussed panels or siding (e.g. siding 110, 210, 262, 322, 372, 410, 420, 465, 475, or any other siding or panel discussed herein). Moreover, a back surface of exterior panels 2102, 2104 may include one or more raised elements to provide an omnidirectional drainage and ventilation path similar to any of raised elements 112, 212, 228, 312, 328, 442, 467 or any other raised elements discussed above. Therefore, exterior panels 2102, 2104 benefit from the ventilation and water drainage advantages discussed herein.

Further yet, exterior panels 2102, 2104 may or may not include overlapping portions 2110, shown in FIG. 21. Overlapping portions may be similar to any of the overlapping structures discussed herein, such as overlapping structures 430, 452 shown above in FIG. 4. Overlapping regions 2110 may be vertical or horizontal with respect to the structure, although only shown in FIG. 21 as vertical.

Exterior panels 2102, 2104 may be of one piece construction and may comprise cement, metal, wood, woodbased, plastic, or other material including composites of these materials.

Figure 22:
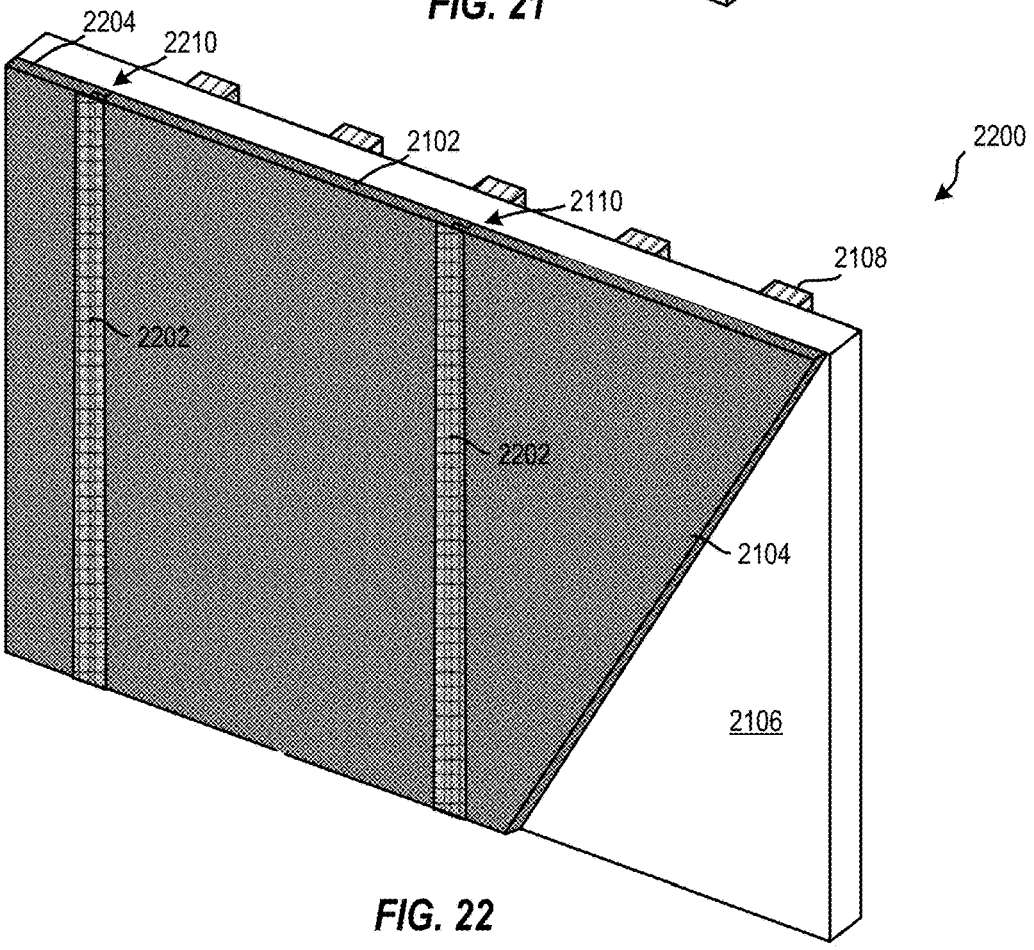
FIG. 22 depicts an additional view of the system of FIG. 21 with a further joint reinforcement and a third exterior panel, in an embodiment.

FIG. 22 depicts an additional view 2200 of system 2100 of FIG. 21 with an optional joint reinforcement 2202 and a third exterior panel 2204, in an embodiment. Third exterior panel 2204 is similar to first and second exterior panels of FIG. 21 discussed above. The joint reinforcement 2202 may include a metal, fiberglass, or plastic grid or mesh material. The joint reinforcement may be a dip or joint cap made of metal, fiberglass, plastic or other material. The joint reinforcement 2202 may serve to reinforce joints between panels, in particular in applications where a finishing coat is applied over the joint and panels. As shown in FIG. 22, however, joint reinforcement 2202 may extend over the surface of the panels and cover an overlapping region 2110 between two exterior panels 2102, 2014. It should be appreciated that if exterior panels do not overlap, then joint reinforcement 2202 may cover the joint between the two exterior panels. In addition, joint reinforcement 2202 need not cover the overlapping region or joint in certain embodiments.

Figure 23:
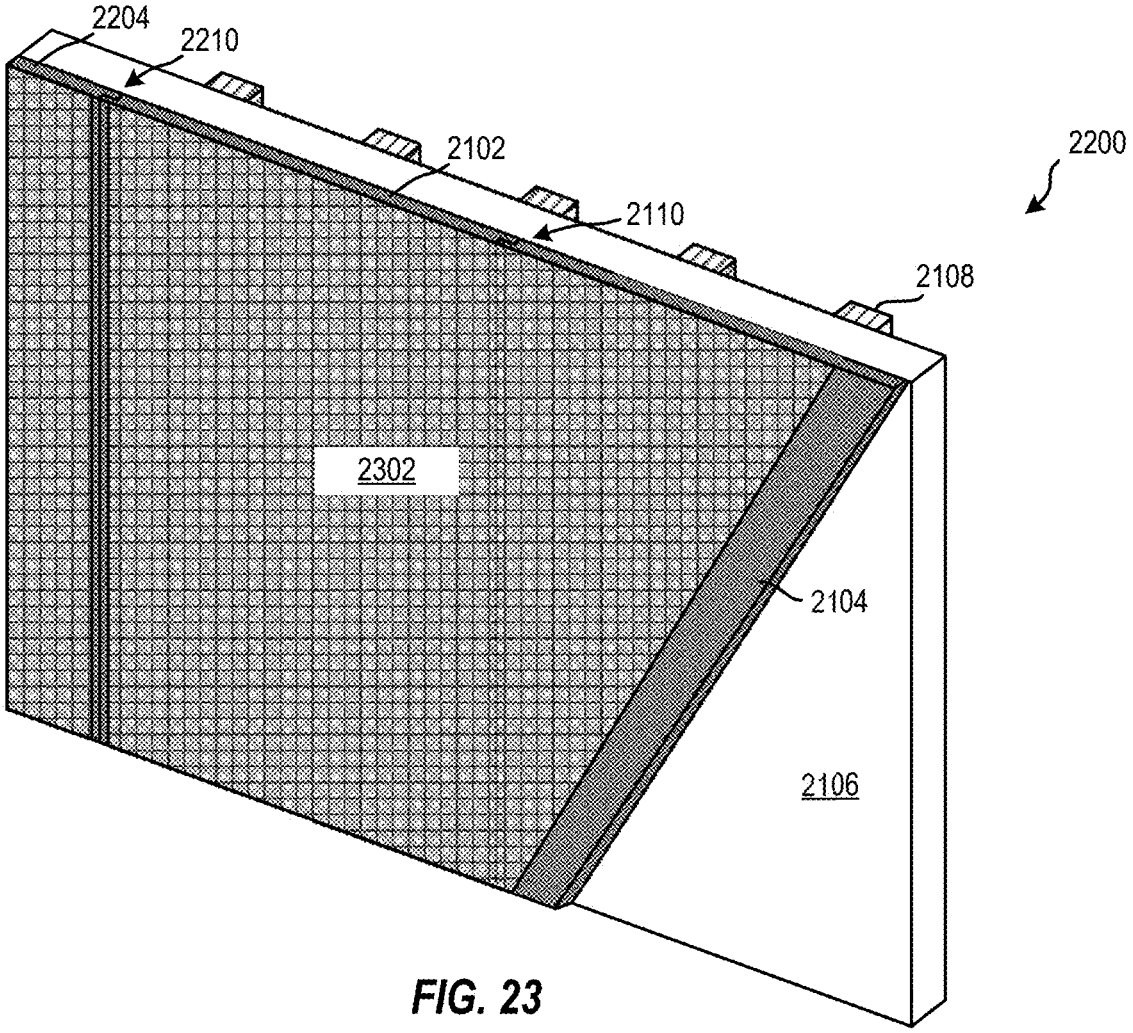
FIG. 23 depicts an alternate embodiment of the joint reinforcement of FIG. 22 where the joint reinforcement extends over the panels and serves as a base for a finishing coat, in an embodiment.

FIG. 23 depicts an alternate embodiment of joint reinforcement 2202 of FIG. 22 where the joint reinforcement extends over the panels 2302 and serves as a base for a finishing coat, in an embodiment. As shown in FIG. 23, joint reinforcement 2302 covers substantially the entire face of exterior panels 2102, 2104. Moreover, FIG. 23 illustrates the principle that the joint reinforcement need not cover all joints. For example, joint reinforcement 2302 does not cover overlapping region 2210. This may create a joint similar to joint 1916 discussed above.

Figure 24:
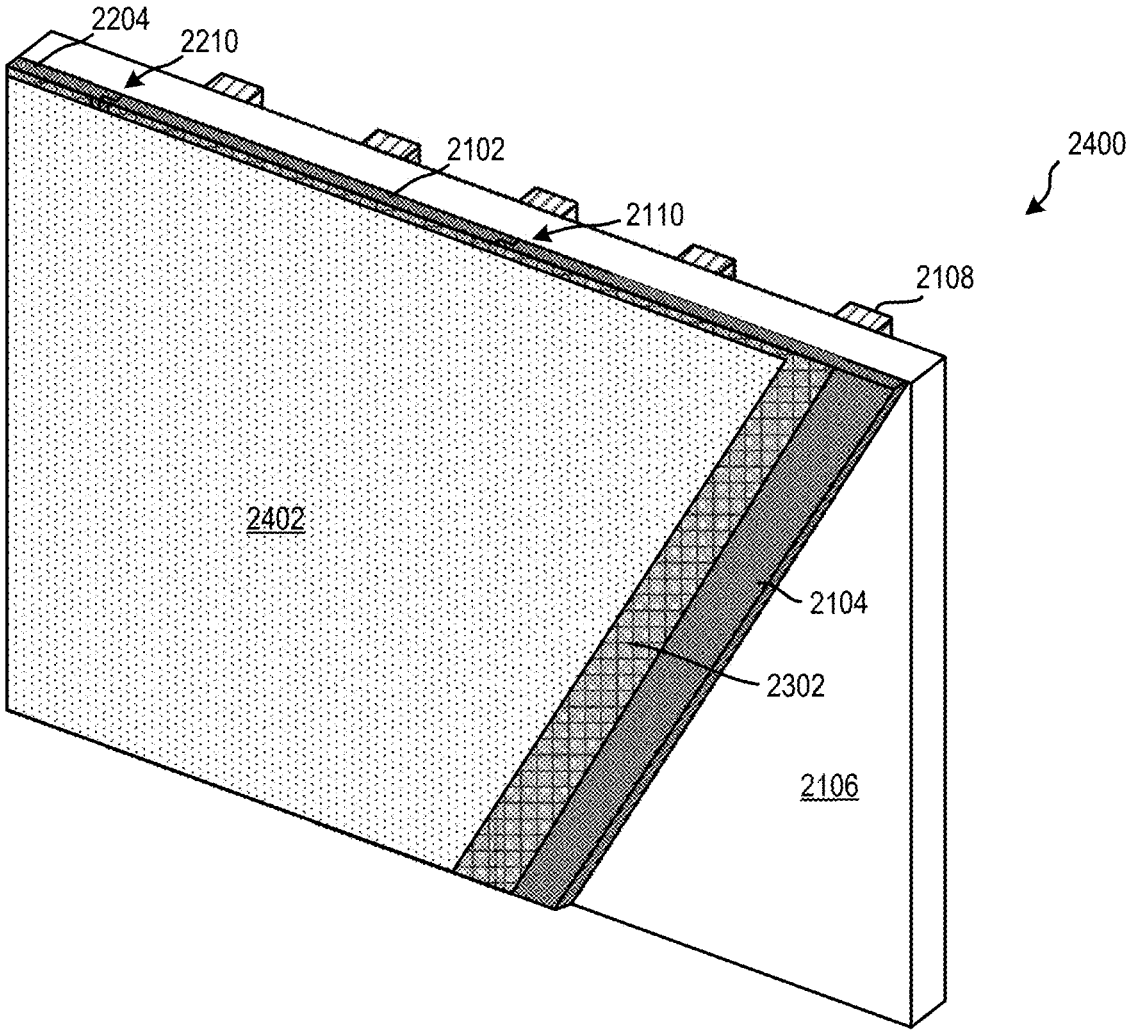
FIG. 24 depicts an additional view of system of FIG. 21 including all components of the view of FIG. 22 as well as a finishing layer, in an embodiment.

FIG. 24 depicts an additional view 2400 of system 2100 of FIG. 21 including all components of view 2200 of FIG. 22 as well as a finishing layer 2402, in an embodiment. Finishing layer 2402 may cover joint reinforcement limited to joints between panels as shown as joint reinforcement 2202 in FIG. 22; or finishing layer may cover joint reinforcement that extends over the panels as 2302 in FIG. 23. Where the joints are not reinforced, such as overlapping regions 2110, 2210; the joints between panels provide control joints for the finishing layer 2402, similar to joints 1916. Finishing layer 2402 may comprise any of paint, plaster, exterior cement plaster, stucco finish coat, synthetic plaster, parge coat, plaster coats, or other similar coatings. In certain embodiments, finishing layer 2402 may be applied directly to exterior panels without inclusion of joint reinforcement 2202. FIG. 24 is shown with finishing layer 2402 over the embodiment of joint reinforcement 2302 that extends over the surface of panels 2102, 2104, 2204 of FIG. 23. However, it should be appreciated that finishing layer 2402 may be applied directly to exterior panels without joint reinforcement that extends over the panels 2302, or to exterior panels with or without joint reinforcement the joints thereof, such as joint reinforcement 2202.

Exterior panels shown in FIGS. 21-24 provide a significant advantage over prior art stucco or other finishing systems. The exterior panels provide a base for other finishing components such as paint, parge coat, stucco finishing layer or any other material that finishing layer 2402 may comprise. Particularly compared to built up stucco systems, the exterior panels remove the need for the first two coats of stucco (e.g. first layer 1910 and second layer 1912, discussed above). The panels will be likely manufactured in a controlled setting providing greater quality control and consistency than field applied scratch and brown coats of built up stucco systems that are subject to mixing and applications as well as defects caused by premature or slow curing as the coats are exposed to the elements. Moreover, the panels, because they include an omnidirectional drainage and ventilation path, the panels may remove the need for a weather barrier, such as weather barrier 1906 providing an additional advantage. Not only do these panels reduce construction time because each of these first two layers need not be subjected to a cure wait time, but cost of labor and materials is also significantly reduced. Moreover, these panels may have beneficial architectural features included as part of the panel(s). For example, although shown as flat or linear panels it is understood that the panels may include architectural features such as curves or other shapes forming cornices, moldings, parapets, or other similar architectural features.

Figure 25:
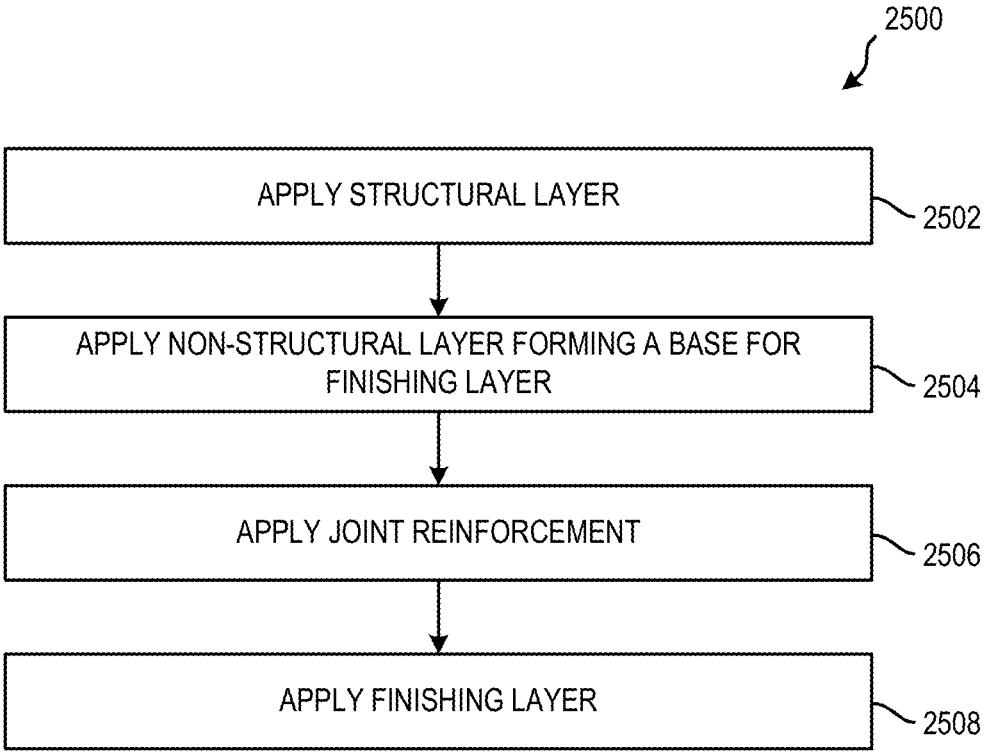
FIG. 25 depicts a flowchart of a method for constructing an exterior surface of a structure, in embodiments.

FIG. 25 depicts a flowchart of method 2500 for constructing an exterior surface of a structure, in embodiments. Method 2500 may be implemented to build system 2100 of FIGS. 21-23.

In step 2502 of method 2500, a structural layer may be installed on framing of a structure. In one example of step 2502, sheathing 2106 may be installed on framing 2108 of a structure.

In step 2404 of method 2500, a non-structural layer forming a base layer for a finishing layer of the structure is applied to the structural layer. In one example of step 2504, exterior panels are applied to the sheathing 2106, such as exterior panels 2102, 2104, and 2204.

In embodiments that include step 2506 of method 2500, a joint reinforcement may be applied to the non-structural layer applied during step 2404. In one example of step 2506, joint reinforcement 2202 is applied to exterior panels 2102, 2104 and 2204. In step 2506, joint reinforcement 2202 may be applied to substantially the entire surface of panels or only at the joints thereof. In one example of step 2506, joint reinforcement 2202 may be applied to every other joint between pluralities of exterior panels.

In step 2508 of method 2500, a finishing layer is applied to the previously generated layers. In one example of step 2508, finishing layer 2402 is applied to joint reinforcement 2202, or alternatively directly to exterior panels 2102, 2104, and 2204.

Figure 14A:
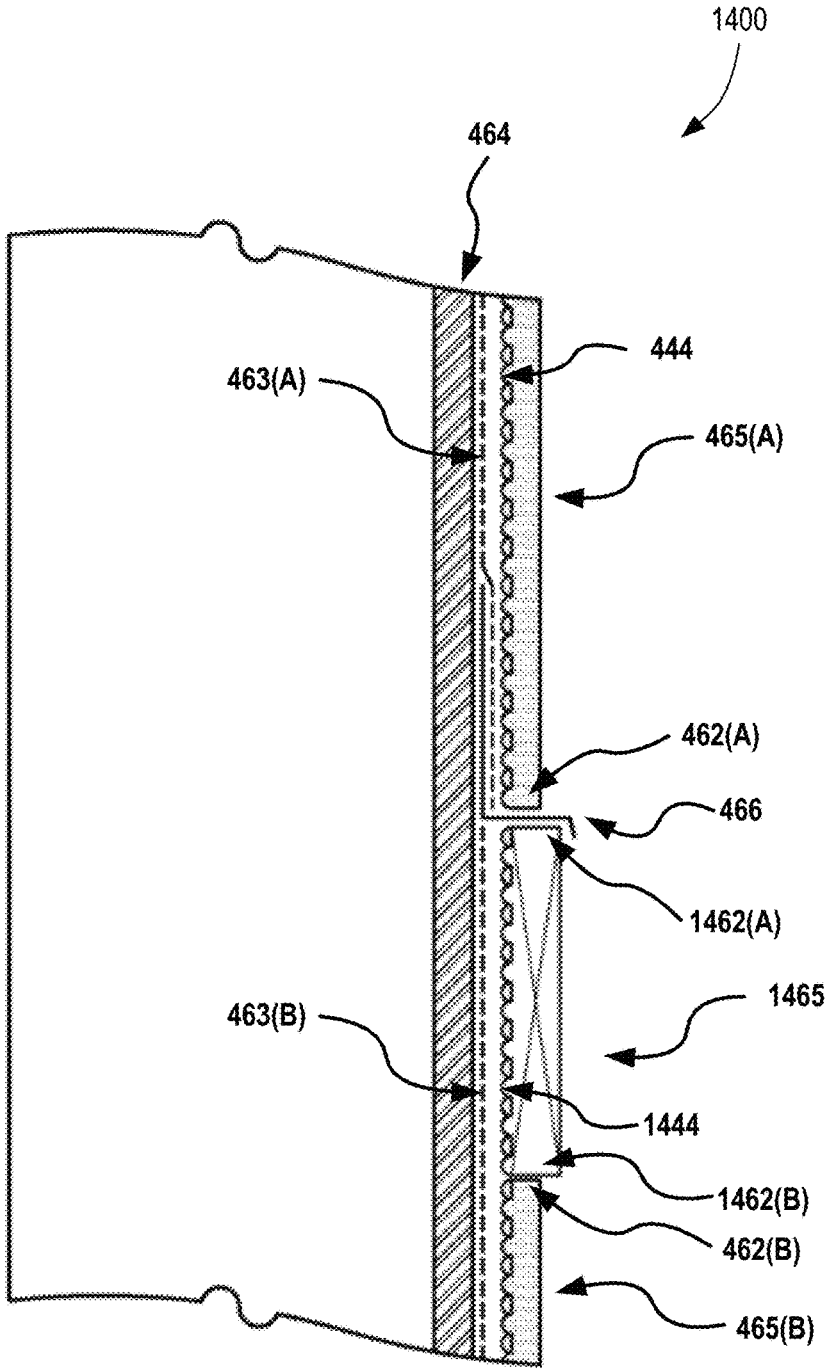
FIG. 14A is a side view of a vented and water control trim-board/molding utilizing a raised pattern of bumps or dots and secured to a structure, according to an embodiment.

Patterned Trim-Board/Molding:

FIG. 14A shows a side view of one exemplary vented and water control trim-board/moldings 1465 secured to a structure, similar to the structure shown in FIG. 5. In the examples of FIG. 14(A), trim-board/molding 1465 is butt jointed with siding 465(A), 465(B) with flashing 466 positioned between flat surface 462(A) and a substantially flat surface 1462(A) of trim-board/molding 1465 such that trim-board/molding 1465 is substantially in the same plane as siding 465(A), 465(B). Flashing 466 is secured to a sheathing 464, for example by nails or screws (not shown), with a weather resistant barrier 463(A) overlaid on top of the upper portion of flashing 466. It will be understood that other methods of joining trim-board/molding 1465 with a siding may be utilized without departing from the scope herein, examples of which include but not limited to, lap joint, overlay, etc.

The disclosed trim-board/molding provides ventilation and water control by providing a raised pattern on the inward facing surface of the trim-board/molding. Examples of a pattern utilized on the trim-board/molding is a pattern of raised bumps/dots 1444 as shown FIG. 14A. This pattern is merely an example of a structure that facilitates ventilation and water control, and is not meant to limit the type, design, size, or configuration of the ventilation and water control raised pattern. In the embodiment of FIG. 14A, the raised pattern is integrally manufactured into the trim-board/molding product. The water control trim-board/molding may, for example, be stamped, embossed, or otherwise formed with a raised surface omnidirectional pattern that provides an air space for ventilation and a drainage plane between the sheathing 464 and the trim-board/molding 1465. The omnidirectional nature of patterns 1444 allows trim-board/molding 1465 to be installed in any orientation without affecting the ventilation and water control properties.

Water control trim-board/molding 1465 may be manufactured using a number of different materials, examples of which include but are not limited to, fiber cement, hardboard, OSB, PVC, wood fiber/resin composite, gypsum, foam, foam insulation, and glass fiber reinforced plastic composite.

Figure 14B:
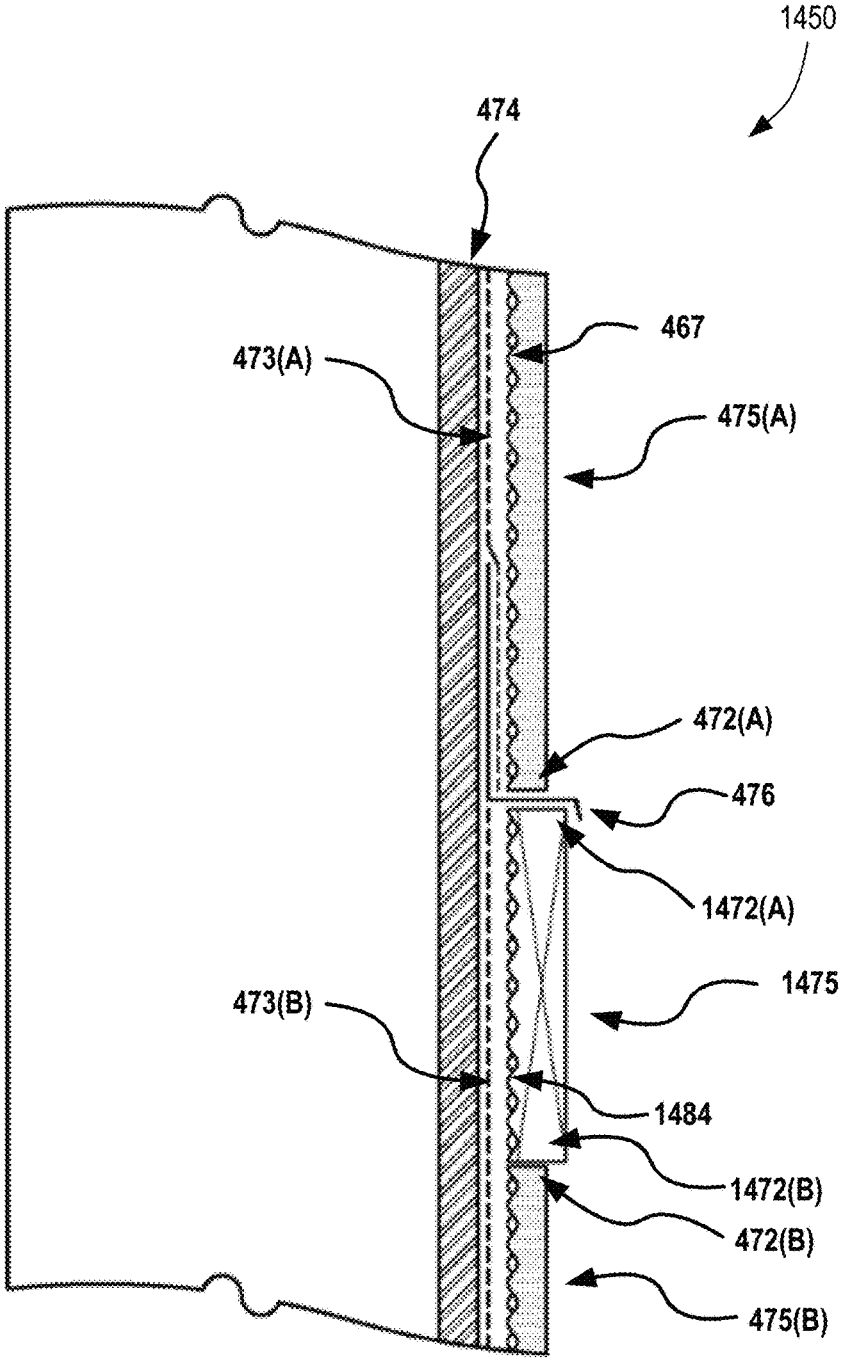
FIG. 14B is a side view of a vented and water control trim-board/molding utilizing an egg-crate or other three-dimensional pattern and secured to a structure, according to an embodiment.

FIG. 14B shows a side view of one exemplary vented and water control trim-board/molding 1475 secured to a structure, similar to the structure shown in FIG. 6. In the examples of FIG. 14(B), trim-board/molding 1475 is butt jointed with siding 475(A), 475(B) with flashing 476 positioned between flat surface 472(A) and a substantially flat surface 1472(A) of trim-board/molding 1475 such that trim-board/molding 1475 is substantially in the same plane as siding 475(A), 475(B). Flashing 476 is secured to sheathing 474, for example by nails or screws (not shown), with a weather resistant barrier 473(A) overlaid on top of the upper portion of flashing 476. It will be understood that other methods of joining trim-board/molding 1475 with a siding may be utilized without departing from the scope herein, examples of which include but not limited to, lap joint, overlay, etc.

The example of a pattern utilized on the trim-board/molding of FIG. 14(B) is an egg crate pattern 1484. Egg crate pattern 1484 is merely an exemplary structure that facilitates ventilation and water control and is not meant to limit the type, design, size, or configuration of the ventilation and water control raised pattern. In the embodiment of FIG. 14B, the raised patterns are integrally manufactured into the trim-board/molding product. The water control trim-board/molding may, for example, be stamped, embossed, or otherwise formed with a raised surface omnidirectional pattern that provides an air space for ventilation and a drainage plane between the sheathing 474 and the trim-board/molding 1475. The omnidirectional nature of patterns 1484 allows trim-board/molding 1475 to be installed in any orientation without affecting the ventilation and water control properties.

Water control trim-board/molding 1475 may be manufactured using a number of different materials, examples of which include, but are not limited to, fiber cement, hardboard, OSB, PVC, wood fiber/resin composite, gypsum, foam, foam insulation, and glass fiber reinforced plastic composite.

While the present invention has been described above, it should be clear that many changes and modifications may be made to the process and product without departing from the spirit and scope of this invention. For example, although pattern 706 is illustrated as a non-directional assortment of round bumps, other omnidirectional raised patterns (pyramids, squares, squiggles or other geometric or random shapes) may also provide drainage channels therebetween. Likewise, a sunken pattern of incuts may be formed into face 704 in place of or in addition to raised surface features 704, such that face 704 provides for attachment to an exterior finish, such as siding or cladding, and the incut pattern forms channels 710.

Figure 15:
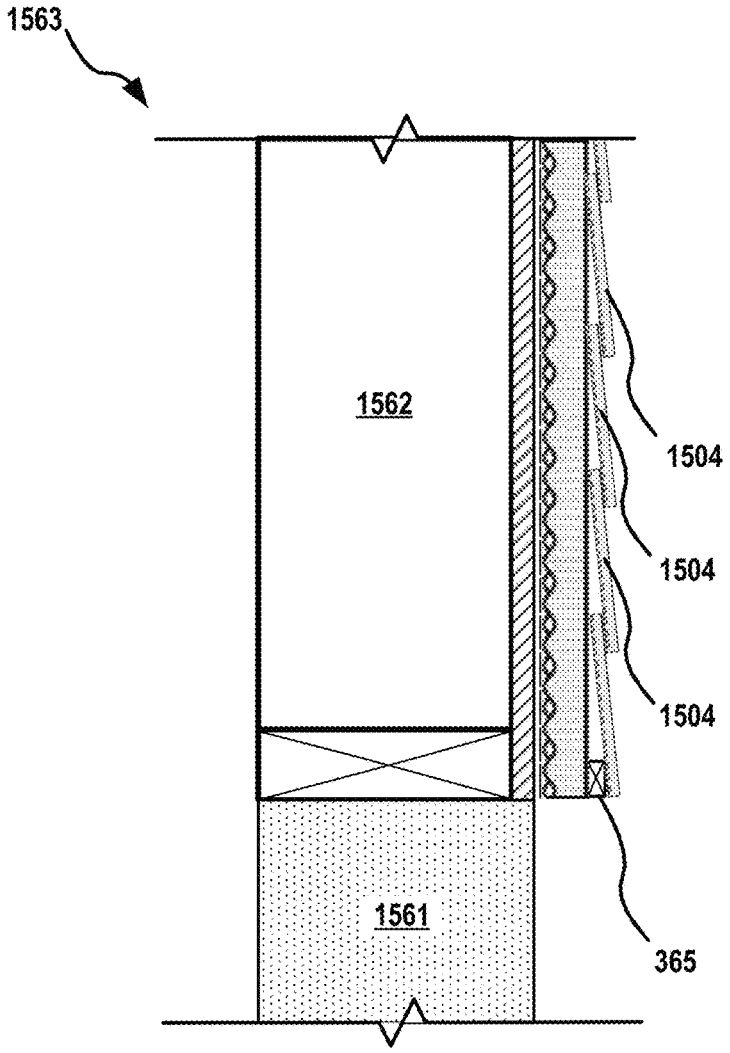
FIG. 15 depicts a cross-section view of an exterior surface of a structure including insulation having an omnidirectional relief pattern thereon, in one embodiment.

Patterned Insulation:

FIG. 15 depicts a cross-sectional view of a structure having an insulation including an omnidirectional relief pattern. Structure 1563 includes sheathing 1554 fixed to a frame 1562 that is set on a foundation 1561. In the embodiment of FIG. 15, sheathing 1554 is a standard sheathing without an omnidirectional relief pattern. Sheathing 1554 may include an optional weather resistant barrier 1556 on the exterior facing surface of sheathing 1556. Insulation 1502 is located exterior to sheathing 1554, or optionally weather resistant barrier 1556. Insulation 1502 is depicted having a grid pattern array of raised bumps forming an omnidirectional relief pattern for providing a drainage and ventilation path between sheathing 1554 and insulation 1502. Exterior to insulation 1502 is lapped siding boards 1504. An optional starter strip 1565 may space the bottom portion of the lowest siding board 1504 from insulation 1502. Siding boards 1504 may be similar to any of siding boards 110, 210, 262, 322, 372. Alternatively, panel siding such as siding 410, 420, 465, or 475, could be exterior to insulation 1502. Therefore, an omnidirectional drainage and ventilation path is created between insulation 1502 and the siding exterior thereto.

Although insulation 1502 is illustrated having omnidirectional relief pattern on the interior surface thereof, in an alternate embodiment, insulation 1502 may have an omnidirectional relief pattern on both the interior surface and the exterior surface thereof. Therefore, standard sheathing and standard siding or cladding may be attached to insulation 1502 while maintaining an omnidirectional drainage and relief path between each layer.

Figure 16:
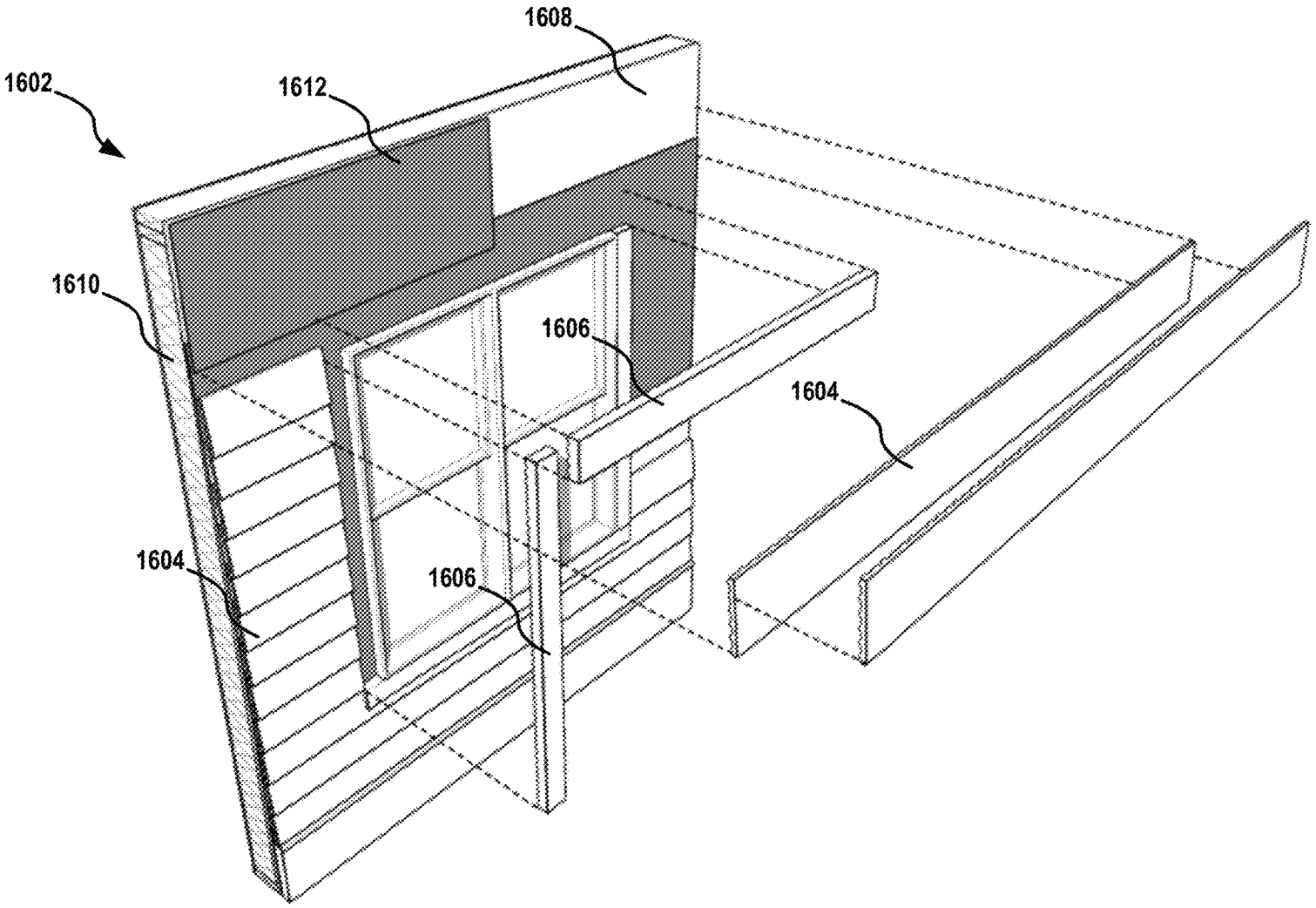
FIG. 16 depicts an environmental view of an exterior surface of a structure including siding having an omnidirectional relief pattern, and trim-board having an omnidirectional relief pattern, in one embodiment.

FIG. 16 depicts an environmental view of an exterior surface 1602 of a structure including siding 1604 having an omnidirectional relief pattern, and trim-board 1606 having an omnidirectional relief pattern, in one embodiment. Surface 1602 may include standard sheathing 1608 attached to framing 1610 of the structure. Sheathing 1608 may further include a weather resistant barrier 1612 located on the exterior surface thereof. Siding 1604 is attached exterior to sheathing, and optional weather resistant barrier 1612. The omnidirectional relief pattern, such as a grid pattern of raised bumps as discussed above (raised dots, egg crate pattern, or raised elements such as pyramids, squares, rectangles, etc.) on the interior surface of siding 1604 creates an omnidirectional path for moisture drainage and air ventilation. Siding 1604 similar to, and include the above discussed features of, any of siding boards 110, 210, 262, 322, 372. Alternatively siding 1604 may be similar to, and include the above discussed features of, any of panel siding 410, 420, 465, or 475, discussed above. Trim-board 1606 is attached exterior to sheathing, and optional weather resistant barrier 1612. The omnidirectional relief pattern, such as a grid pattern of raised bumps as discussed above (raised dots, egg crate pattern, or raised elements such as pyramids, squares, rectangles, etc.) on the interior surface of trim-board 1606 creates an omnidirectional path for moisture drainage and air ventilation. Trim-board 1606 may be similar to, and include the above discussed features of, trim-board 1465 or 1475.

Figure 17:
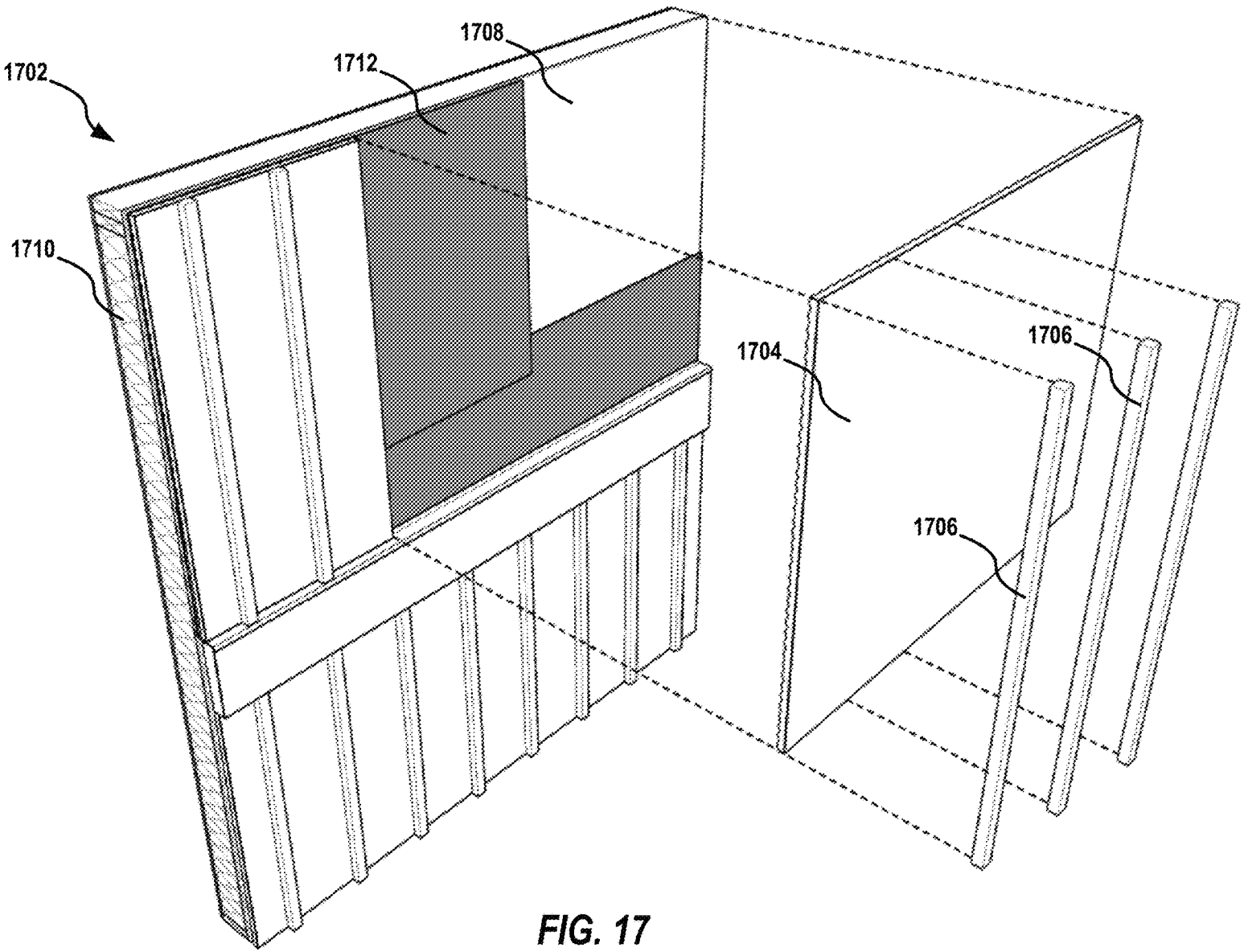
FIG. 17 depicts an environmental view of an exterior surface of a structure including a siding, or cladding, panel having an omnidirectional relief pattern on the back side thereof, with optional battens on the exterior surface thereof, in one embodiment.

FIG. 17 depicts an environmental view of an exterior surface 1702 of a structure including a siding, or cladding, panel 1704 having an omnidirectional relief pattern on the back side thereof, with optional battens 1706 on the exterior surface thereof, in one embodiment. Surface 1702 may include standard sheathing 1708 attached to framing 1710 of the structure. Sheathing 1708 may further include an optional weather resistant barrier 1712 located on the exterior surface thereof. Siding or cladding panels 1704 are attached exterior to sheathing, and optional weather resistant barrier 1712. The omnidirectional relief pattern, such as a grid pattern of raised bumps as discussed above (raised dots, egg crate pattern, or raised elements such as pyramids, squares, rectangles, etc.) on the interior surface of siding or cladding 1704 creates an omnidirectional path for moisture drainage and air ventilation. Siding or cladding 1704 similar to, and include the above discussed features of, any of siding panels 410, 420, 465, or 475. Battens 1706 may be included on the exterior surface of panels 1704 to create a board and batten look on the exterior surface of the structure, while still maintaining an omnidirectional path for moisture drainage and air ventilation.

Omnidirectional drainage and ventilation provides significant advantages. As compared to linear drainage and ventilation systems, such as those with horizontal or vertical grooves or protrusions, the omnidirectional path provides an easier path for drainage and ventilation. Further, should one path get impeded, for example by dirt and debris, the air and moisture is easily redirected through another path. Moreover, the omnidirectional relief pattern may be manufactured using pressboard molding, stamping, or otherwise engraving. This simplifies manufacturing and thereby reduces associated costs. Further, because the omnidirectional relief pattern is not limited to a particular direction, large panels may be manufactured with the omnidirectional relief pattern and then cut into smaller sections without concern for the direction of the relief pattern. Additionally, where sheathing or insulation includes an omnidirectional relief pattern on an exterior (or interior) facing surface thereof, standard siding may be utilized while still achieving the moisture drainage and air ventilation benefits discussed herein.

Features described above as well as those claimed below may be combined in various ways without departing from the scope hereof. The following examples illustrate some possible, non-limiting combinations:

(A1) A vented and water control panel for securing to the exterior of a structure, the panel including an omnidirectional relief pattern formed on a back surface of the vented and water control panel.

(A2) In the vented and water control panel of (A1), wherein the omnidirectional relief pattern forms an omnidirectional ventilation and drainage plane.

(A3) In either of the vented and water control panels of (A1) or (A2), wherein the omnidirectional relief pattern is formed as a grid pattern of raised elements.

(A4) In the vented and water control panel of (A3), wherein the raised elements are raised bumps or "dots" with air space on all sides.

(A5) In the vented and water control panel of (A3), wherein the raised elements are in an egg-crate pattern.

(A6) In any of the vented and water control panels of (A1) through (A5), further comprising a securing hole on a front surface of vented and water control panel that corresponds to at least one element of the omnidirectional relief pattern.

(A7) In any of the vented and water control panels of (A1) through (A6), further comprising overlapping structures for installing a first vented and water control panel substantially coplanar with a second, adjacent vented and water control panel.

(A8) In any of the vented and water control panels of (A1) through (A7), wherein the back surface has a top and a bottom and a raised element at the bottom of the back side has a height that is greater than a raised element at the top of the back side.

(A9) In any of the vented and water control panels of (A1) through (A7), wherein the back surface has a top and a bottom and a raised element at the top of the back side has a height that is greater than a raised element at the bottom of the back side.

(A10) In any of the vented and water control panels of (A1) through (A9), wherein the omnidirectional drainage plane forms an omnidirectional path, such that moisture and/or air may move substantially unimpeded along the siding's length and width.

(A11) In any of the vented and water control panels of (A1) through (A10), the panel being formed as a trim board panel.

(A12) In any of the vented and water control panels of (A1) through (A10), the panel being formed as siding.

(A13) In any of the vented and water control panels of (A1) through (A10), the panel being formed as cladding.

(A14) In any of the vented and water control panels of (A1) through (A10), the panel being formed as insulation, wherein an additional omnidirectional relief pattern formed on a front surface of the vented and water control panel; wherein the additional omnidirectional relief pattern forms an additional omnidirectional ventilation and drainage plane for moving water and water vapor.

(A15) In any of the vented and water control panels of (A1) through (A14), further comprising a weather resistant barrier applied to the omnidirectional relief pattern.

(A16) In the vented and water control panel of (A15), wherein the weather resistant barrier is applied in liquid form.

(A17) In the vented and water control panel of (A16), wherein the weather resistant barrier is applied by spraying, painting or dipping the outer face.

(A18) In any of the vented and water control panels of (A1) through (A17), the panel being formed from foam material, wherein the omnidirectional relief pattern are integral with an outer face of the panel.

(B1) A vented and water control panel sheathing, including a panel body having an outer face, and an inner face; a plurality of raised surface features extending from the outer face in the form of an omnidirectional relief pattern to provide points of contact between the panel body and an exterior finish, when the exterior finish is applied with the sheathing; and a plurality of channels formed between the raised surface features to facilitate omnidirectional draining and/or ventilation between the panel and the applied exterior finish.

(B2) In the vented and water control panel sheathing of (B1), the panel sheathing further comprising a weather resistant barrier applied to the outer face, including the raised surface features and the channels.

(B3) In the vented and water control panel sheathing of (B2), wherein the weather resistant barrier is applied in liquid form.

(B4) In the vented and water control panel sheathing of (B3), wherein the weather resistant barrier is applied by spraying, painting or dipping the outer face.

(B5) In any of the vented and water control panel sheathings of (B1) through (B4), wherein the vented and water control panel sheathing is an Oriented Strand Board (OSB) panel and the raised surface features are formed from smaller wood strands forming the outer face; wherein strands of the inner face and/or core are larger than the strands of the outer face.

(B6) In the vented and water control panel sheathing of (B5), wherein the raised surface features are stamped or embossed into the outer face.

(B7) In the vented and water control panel sheathing of (B5), the panel sheathing being formed from foam material, wherein the raised surface features are integral with the outer face.

(B8) In any of the vented and water control panel sheathings of (B1) through (B7), the raised surface comprising a plurality of dots protruding from the outer face.

(B9) In any of the vented and water control panel sheathings of (B1) through (B7), the omnidirectional relief pattern comprising an egg-crate pattern of the raised elements.

(B10) In any of the vented and water control panel sheathings of (B1) through (B9), further comprising another plurality of raised features extending from the inner face in the form of an omnidirectional relief pattern to provide points of contact between the panel body and an interior support of a building, when the sheathing is installed on the building.

(B11) In the vented and water control panel sheathing of (B10), the interior support being a roof rafter of the building.

(C1) A structure having improved water drainage and air ventilation, the structure comprising: a first layer having an interior facing surface and an exterior facing surface, the exterior facing surface having an omnidirectional relief pattern of raised elements thereon; wherein the omnidirectional relief pattern forms an omnidirectional ventilation and drainage plane.

(C2) In the structure of (C1), the first layer being a siding layer, the omnidirectional relief pattern forming contact points between the siding layer and an internal layer of the structure.

(C3) In any of the structures of (C1) through (C2), the internal layer including a weather resistant layer.

(C4) In any of the structures of (C1) through (C3), the internal layer being a sheathing layer.

(C5) In any of the structures of (C1) through (C4), the first layer being a lapped siding layer, the omnidirectional relief pattern further forming contact points between a first siding board of the lapped siding layer and an exterior surface of an adjacent siding board of the lapped siding layer.

(C6) In any of the structures of (C1) through (C5), the first layer comprising a trim-board layer, the omnidirectional relief pattern forming contact points between the trim-board layer and an internal layer of the structure.

(C7) In any of the structures of (C1) through (C4), the first layer being a sheathing layer, the omnidirectional relief pattern forming contact points between the sheathing layer and an external layer of the structure.

(C8) In the structure of (C7), the external layer being one or more of a siding layer, a cladding layer, a trim-board layer, and a weather resistant layer.

(C9) In any of the structures of (C7) through (C8), the sheathing layer further comprising another omnidirectional relief pattern of raised elements on the interior facing surface.

(C10) In the structure of (C9), the sheathing layer being attached to sidewall framing of the structure.

(C11) In the structure of (C9), the sheathing layer being attached to a rafter of a roof of the structure.

(C12) In any of the structures of (C1) through (C11), the omnidirectional relief pattern being a grid pattern of raised elements.

(C13) In the structure of (C12), wherein the raised elements are raised bumps or "dots" with air space on all sides.

(C14) In the structure of (C12), wherein the raised elements are in an egg-crate pattern.

(C15) In any of the structures of (C12) through (C14), wherein the raised elements differ in height from a top to a bottom of the first layer.

(C16) In any of the structures of (C12) through (C14), wherein the raised elements differ in height from a bottom to a top of the first layer.

(C17) In any of the structures of (C3) through (C16), wherein the weather resistant barrier is applied in liquid form.

(C18) In the structure of (C17), wherein the weather resistant barrier is applied by spraying, painting or dipping the outer face.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A vented and water control system, comprising:

a first exterior cladding panel:

configured to be mounted adjacent to a second exterior cladding panel at a wall of a structure in an installed configuration, being comprised of glass fiber reinforced plastic having a front surface, a back surface, and an omnidirectional relief pattern integral with the back surface and defined by a plurality of elements that form a ventilation and drainage plane between the wall and the back surface in the installed configuration, the first exterior cladding panel defining a securing hole at the front surface, and, having an overlapped portion that is concealed by the second exterior cladding panel in the installed configuration; and, a non-structural finish layer located on the first exterior cladding panel.

2. The vented and water control system of claim 1, wherein the non-structural finish layer is a weather resistant coating.

3. The vented and water control system of claim 1, the securing hole located in a position concealed by an overlapping portion of the second exterior cladding panel when the first and the second exterior cladding panels are in the installed configuration.

4. The vented and water control system of claim 1, the non-structural finish layer selected from the group consisting of one or more of paint, plaster, exterior cement plaster, synthetic plaster, stucco, parge coat, wood-based coating, and resins; the wood-based coating selected from the group including one or more of wood fibers, paper, and cellulose.

5. The vented and water control system of claim 1, the non-structural finish layer covering at least one joint between the first exterior cladding panel and an adjacent exterior cladding panel mounted adjacent to the first exterior cladding panel in the installed configuration.

6. The vented and water control system of claim 5, the non-structural finish layer not including metal lath.

7. The vented and water control system of claim 5, the first exterior cladding panel being a non-structural panel.

8. The vented and water control system of claim 5, the relief pattern being located on a portion, but not all of the back surface.

9. The vented and water control system of claim 5, at least one of:

the plurality of elements being a plurality of raised elements forming a grid;

the plurality of elements being a plurality of raised bumps or dots with air space on all sides;

the plurality of elements having an egg-crate pattern;

the plurality of elements being a pyramid, square, squiggle, rectangle, or geometric shape;

the plurality of elements being in a random pattern; and the plurality of elements being incuts formed into the back surface.

10. The vented and water control system of claim 5, the plurality of elements being stamped, formed with, or embossed into the first exterior cladding panel.

11. The vented and water control system of claim 5, the glass fiber reinforced plastic including foam insulation.

12. The vented and water control system of claim 5, one or more architectural features being located on the front surface of the first exterior cladding panel, each architectural feature forming a cornice, molding, or parapet.

13. The vented and water control system of claim 5, further including a joint reinforcement located at an edge of the first exterior cladding panel.

14. The vented and water control system of claim 13, the joint reinforcement being a mesh, clip, or joint cap.

15. A vented and water control system, comprising:

an exterior cladding panel configured to be mounted at a wall of a structure, the exterior cladding panel comprising glass fiber reinforced plastic having a front surface, a back surface, and an omnidirectional relief pattern integral with the back surface and defined by a plurality of elements that form an omnidirectional ventilation and drainage plane between the wall and the back surface when the exterior cladding panel is mounted at the wall; and, at least one architectural feature located on the front surface, the architectural feature forming a cornice, molding, or parapet.

16. The vented and water control system of claim 15, the exterior cladding panel defining a securing hole located therein.

17. The vented and water control system of claim 15, the exterior cladding panel being a non-structural panel.

18. The vented and water control system of claim 15, at least one of:

the plurality of elements being a plurality of raised elements forming a grid;

the plurality of elements being a plurality of raised bumps or dots with air space on all sides;

the plurality of elements having an egg-crate pattern;

the plurality of elements being a pyramid, square, squiggle, rectangle, or geometric shape;

the plurality of elements being in a random pattern; and the plurality of elements being incuts formed into the back surface.

19. The vented and water control system of claim 15, the plurality of elements being stamped, formed with, or embossed into the exterior cladding panel.

20. The vented and water control system of claim 15, the glass fiber reinforced plastic including foam insulation.

21. The vented and water control system of claim 15, further including a joint reinforcement located at an edge of the exterior cladding panel.

22. The vented and water control system of claim 21, the joint reinforcement being a mesh, clip, or joint cap.

* * * * *